US009921543B2

(12) United States Patent
Sato et al.

(10) Patent No.: US 9,921,543 B2
(45) Date of Patent: Mar. 20, 2018

(54) IMAGE-FORMING APPARATUS PROVIDED WITH SUPPORT PARTS FOR SUPPORTING CARTRIDGE DETACHED FROM HOUSING

(71) Applicant: Brother Kogyo Kabushiki Kaisha, Nagoya-shi, Aichi-ken (JP)

(72) Inventors: Shougo Sato, Seto (JP); Yasuo Fukamachi, Nagoya (JP); Motoaki Mushika, Hashima (JP); Kazuna Taguchi, Nagoya (JP); Takehiro Masuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/420,775

(22) Filed: Jan. 31, 2017

(65) Prior Publication Data

US 2017/0219995 A1 Aug. 3, 2017

(30) Foreign Application Priority Data

Feb. 2, 2016 (JP) ..... 2016-017926

(51) Int. Cl.
*G03G 21/18* (2006.01)

(52) U.S. Cl.
CPC ..... *G03G 21/1814* (2013.01); *G03G 21/1817* (2013.01); *G03G 21/1853* (2013.01)

(58) Field of Classification Search
CPC ..... G03G 21/1814; G03G 21/1817; G03G 21/1853; G03G 21/1846; G03G 2221/183;

(Continued)

(56) References Cited

U.S. PATENT DOCUMENTS 8,010,014 B2 8/2011 Noguchi
9,026,000 B2 5/2015 Noguchi
(Continued)

FOREIGN PATENT DOCUMENTS

JP H08-016062 A 1/1996
JP 2002-207408 A 7/2002
(Continued)

OTHER PUBLICATIONS

Machine translation of JP 2002-207408 (publication date of Jul. 26, 2002) printed on Aug. 22, 2017.*

*Primary Examiner* — Sophia S Chen
(74) *Attorney, Agent, or Firm* — Banner & Witcoff, Ltd.

(57) ABSTRACT

An image-forming apparatus includes: a housing formed with an opening part; and a process cartridge detachably attachable to the housing through the opening part in a first direction. The housing includes a first support part arranged at the opening part, and a cover movable between a closed position and an opened position. The cover includes a second support part positioned away from the first support part in the first direction when the cover is at the opened position. The process cartridge includes: a drum cartridge having a drum frame; and a toner cartridge detachably attachable to the drum frame. When the cover is at the opened position, the first support part and the second support part are configured to support the drum frame of the process cartridge detached from the housing to restrict displacement of the drum frame in the first direction.

14 Claims, 15 Drawing Sheets

(58) Field of Classification Search
CPC ... G03G 2221/1846; G03G 2221/1853; G03G 2221/169
USPC ..... 399/113
See application file for complete search history.

(56) References Cited

U.S. PATENT DOCUMENTS

| | | | | |
|---|---|---|---|---|
| 2005/0207783 | A1* | 9/2005 | Sugimura | G03G 21/1853 399/111 |
| 2005/0265757 | A1* | 12/2005 | Deguchi | B65H 29/56 399/316 |
| 2007/0009281 | A1* | 1/2007 | Sato | 399/90 |
| 2007/0166070 | A1* | 7/2007 | Sato | G03G 21/1821 399/90 |
| 2010/0080617 | A1 | 4/2010 | Noguchi | |
| 2012/0321344 | A1 | 12/2012 | Noguchi | |
| 2015/0055976 | A1* | 2/2015 | Murakami | 399/110 |
| 2017/0153597 | A1* | 6/2017 | Sato | G03G 21/1814 |
| 2017/0160697 | A1* | 6/2017 | Sato | |

FOREIGN PATENT DOCUMENTS

| | | | |
|---|---|---|---|
| JP | 2006-058350 | A | 3/2006 |
| JP | 2010-102321 | A | 5/2010 |

* cited by examiner

IMAGE-FORMING APPARATUS PROVIDED WITH SUPPORT PARTS FOR SUPPORTING CARTRIDGE DETACHED FROM HOUSING

CROSS REFERENCE TO RELATED APPLICATION

This application claims priority from Japanese Patent Application No. 2016-017926 filed Feb. 2, 2016. The entire content of the priority application is incorporated herein by reference.

TECHNICAL FIELD

The present disclosure relates to an electro-photographic type image-forming apparatus.

BACKGROUND

An electro-photographic type image-forming apparatus is well-known in the art. The apparatus is provided with a process cartridge accommodating toner and having a photosensitive drum and a developing sleeve.

One of such image-forming apparatuses includes a main body provided with a cartridge door that is adapted to be opened for replacement of a process cartridge with a new cartridge or for maintenance to the process cartridge at the time of sheet jamming. During such replacement or maintenance, the process cartridge can be temporarily placed a cartridge-door guide provided in the cartridge door.

SUMMARY

However, in the above image-forming apparatus, the process cartridge is merely temporarily placed on the cartridge-door guide. Therefore, the process cartridge may be easily fall off the cartridge-door guide due to a small impact or vibration.

Further, it is conceivable in this image-forming apparatus to employ a process cartridge including a drum cartridge and a toner cartridge separable therefrom. In this case, there is desirable that the toner cartridge be easily replaced with a new toner cartridge while the drum cartridge is placed on the cartridge-door guide.

In view of the foregoing, it is an object of the present disclosure to provide an image-forming apparatus capable of easily replacing a toner cartridge with a new toner cartridge relative to the drum cartridge while the process cartridge is fixed by a housing and a cover.

In order to attain the above and other objects, the disclosure provides an image-forming apparatus including a housing and a process cartridge. The housing is formed with an opening part and includes: a first support part arranged at the opening part; and a cover movable between a closed position closing the opening part and an opened position exposing the opening part. The process cartridge is detachable and attachable relative to the housing through the opening part in a first direction when the cover is at the opened position. The cover includes a second support part that is positioned away from the first support part in the first direction when the cover is at the opened position. The process cartridge includes a drum cartridge and a toner cartridge. The drum cartridge includes a photosensitive drum and a drum frame supporting the photosensitive drum. The toner cartridge is attachable to and detachable from the drum frame, the process cartridge detached from the housing being configured to be supported by the housing such that the drum frame is supported by the first support part and the second support part to restrict displacement of the drum frame in the first direction when the cover is at the opened position.

DETAILED DESCRIPTION

First Embodiment

Hereinafter, an image-forming apparatus 1 according to a first embodiment of the disclosure will be described with reference to FIGS. 1 through 9.

In the following description, directions will be referred to based on those illustrated in drawings.

1. Overview of the Printer

Figure 1:
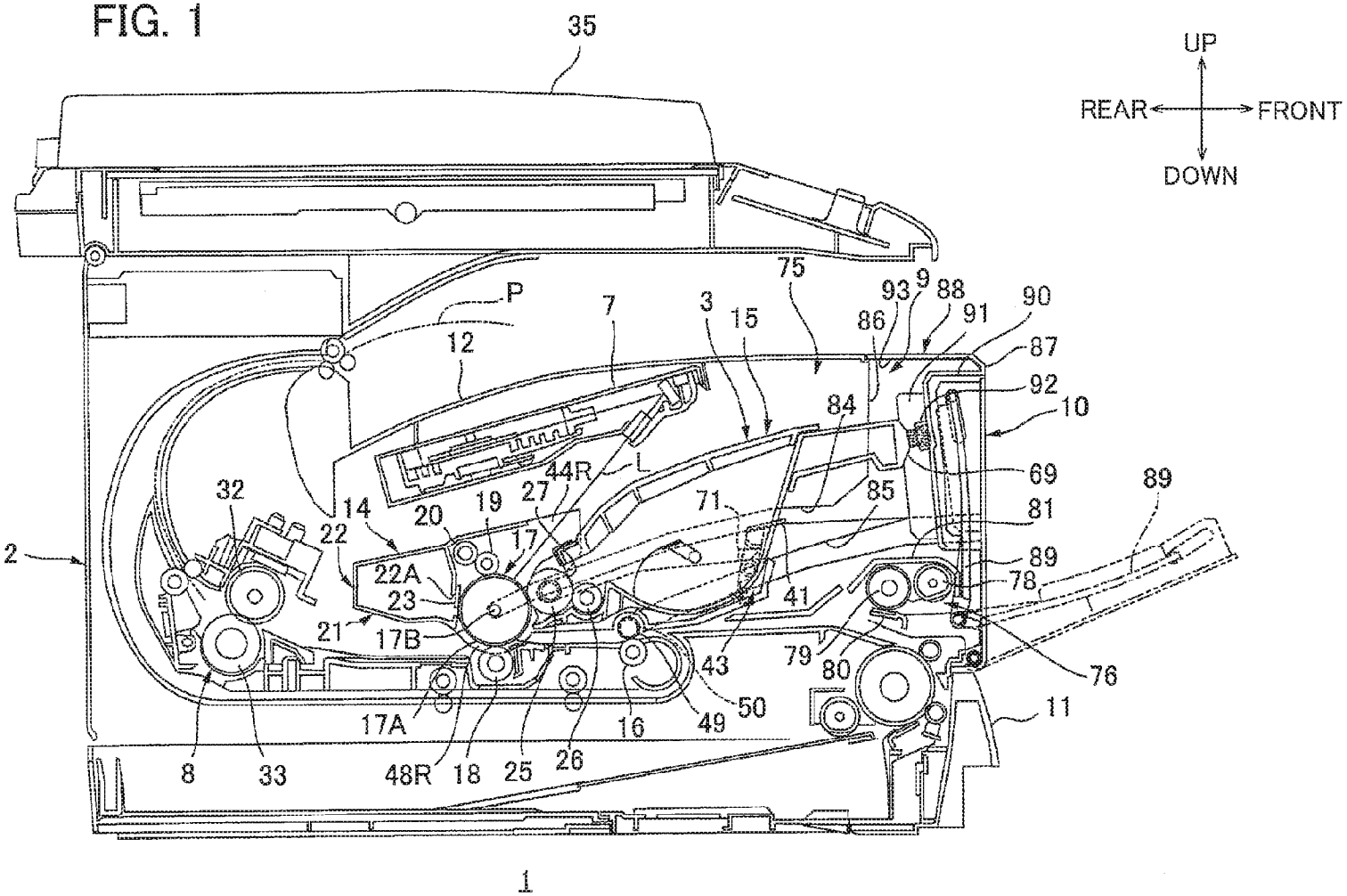
FIG. 1 is a cross-sectional side view of an image-forming apparatus according to a first embodiment.

As illustrated in FIG. 1, the image-forming apparatus 1 is an electro-photographic type monochromatic printer. The image-forming apparatus 1 includes a housing 2 formed with an opening part 9, a process cartridge 3, a scanner unit 7, a first conveyer roller 16, a transfer roller 18, a fixing unit 8, and a reader unit 35.

The housing 2 is generally box-shaped, and is provided with a cover 10, a sheet tray 11, and a discharge tray 12.

The opening part 9 is formed in a front end portion of the housing 2, and is configured to provide communication between inside and outside of the housing 2. The opening part 9 can allow the process cartridge 3 to pass therethrough.

The cover 10 is positioned at the front end portion of the housing 2. The cover 10 is generally plate shaped. The cover 10 has a lower end portion that is pivotally movably supported by the front end portion of the housing 2, so that the cover 10 is pivotally movable between a closed position closing the opening part 9 (shown in a solid line in FIG. 1) and an opened position (see FIG. 5) exposing the opening part 9. In the closed position, the cover 10 extends in a vertical direction.

The sheet tray 11 is positioned at a lower end portion of the housing 2 for accommodating therein sheets P.

The discharge tray 12 is provided at a general center in an upper surface of the housing 2 in a front-rear direction. The discharge tray 12 is recessed downward from the upper surface so as to receive the sheets P.

The process cartridge 3 is detachable from and attachable to the housing 2. When attached to the housing 2, the process cartridge 3 is positioned at a generally vertical center in the housing 2. The attached process cartridge 3 is positioned above the sheet tray 11 and below the discharge tray 12 in the housing 2. The process cartridge 3 includes a drum cartridge 14 and a developing cartridge 15 (as an example of a toner cartridge).

The drum cartridge 14 includes a photosensitive drum 17, a charging roller 19 for charging a peripheral surface of the photosensitive drum 17, a charged cleaning roller 20 for removing extraneous matter such as residual toner and paper dust deposited on a surface of the charging roller 19, and a cleaning unit 21 (as an example of a cleaner) for collecting and accumulating extraneous matter on the photosensitive drum 17.

The photosensitive drum 17 is provided at a lower end portion of the drum cartridge 14. The photosensitive drum 17 is generally cylindrical extending in a left-right direction.

The developing cartridge 15 is attachable to and detachable from the drum cartridge 14. When attached to the drum cartridge 14, the developing cartridge 15 is positioned frontward of the photosensitive drum 17 (see FIG. 3). The developing cartridge 15 can accommodate toner therein. The developing cartridge 15 includes a developing roller 25, a supply roller 26, and a layer-thickness regulation blade 27.

The developing roller 25 is positioned at a lower end portion of the developing cartridge 15. When the developing cartridge 15 is attached to the drum cartridge 14, the developing roller 25 is in contact with the peripheral surface of the photosensitive drum 17. The developing cartridge 15 is rotatably supported by a frame (developing frame 62) of the developing cartridge 15.

The supply roller 26 is positioned frontward of the developing roller 25, and is in contact with a surface of the developing roller 25. The supply roller 26 is rotatably supported to the developing frame 62 of the developing cartridge 15.

The layer-thickness regulation blade 27 is positioned frontward of the developing roller 25. The layer-thickness regulation blade 27 has a lower end portion that is in contact with the surface of the developing roller 25 at a position generally upward of the supply roller 26.

The scanner unit 7 is positioned above the attached process cartridge 3, and is configured to irradiate a laser beam L toward the photosensitive drum 17 based on image data.

The first conveyer roller 16 is positioned above the sheet tray 11.

The transfer roller 18 is positioned rearward of the first conveyer roller 16 and downward of the photosensitive drum 17. The transfer roller 18 can make contact with the photosensitive drum 17 when the process cartridge 3 is mounted in the housing 2.

The fixing unit 8 is positioned rearward of the attached process cartridge 3. The fixing unit 8 includes a heat roller 32 and a pressure roller 33 in contact therewith.

The reader unit 35 is provided to be located above the housing 2. The reader unit 35 is positioned above the discharge tray 12 with a gap therebetween. The reader unit 35 is a flat-bed type image scanner, and is configured to read image information on an original document.

In the image-forming apparatus 1, an image forming operation is started under a control by a controller (not shown). The charging roller 19 uniformly charges the peripheral surface of the photosensitive drum 17. The scanner unit 7 emits the laser beam L to expose the peripheral surface of the photosensitive drum 17 to light, thereby forming thereon an electrostatic latent image based on the image data.

The supply roller 26 is configured to supply the toner stored in the developing cartridge 15 to the developing roller 25. At this time, the toner is triboelectrically charged with a positive polarity between the developing roller 25 and the supply roller 26, so that the positively charged toner is carried on the surface of the developing roller 25. The layer-thickness regulation blade 27 is adapted to regulate a thickness of a toner layer carried on the developing roller 25 into a uniform thickness.

Then, the toner carried on the developing roller 25 is supplied to the electrostatic latent image formed on the peripheral surface of the photosensitive drum 17, forming a toner image on the peripheral surface of the photosensitive drum 17.

The sheets P are configured to be delivered from the sheet tray 11 one by one at a prescribed timing, and each sheet P is then supplied to a position between the photosensitive drum 17 and the transfer roller 18 by rotation of the first conveyer roller 16 and a second conveying roller 49 described later. The toner image on the peripheral surface of the photosensitive drum 17 is transferred onto the sheet P when the sheet P passes through the position between the photosensitive drum 17 and the transfer roller 18.

Then, the sheet P passes through a position between the heat roller 32 and the pressure roller 33, whereby the sheet P is heated and pressed to thermally fix the toner image to the sheet P. The sheet P is then discharged onto the discharge tray 12.

2. Process Cartridge

The process cartridge 3 is attachable to and detachable from the housing 2. In the following description, the process cartridge 3 will be described to be in a state attached to the housing 2, as a basic state.

(1) Drum Cartridge

Figure 2A:
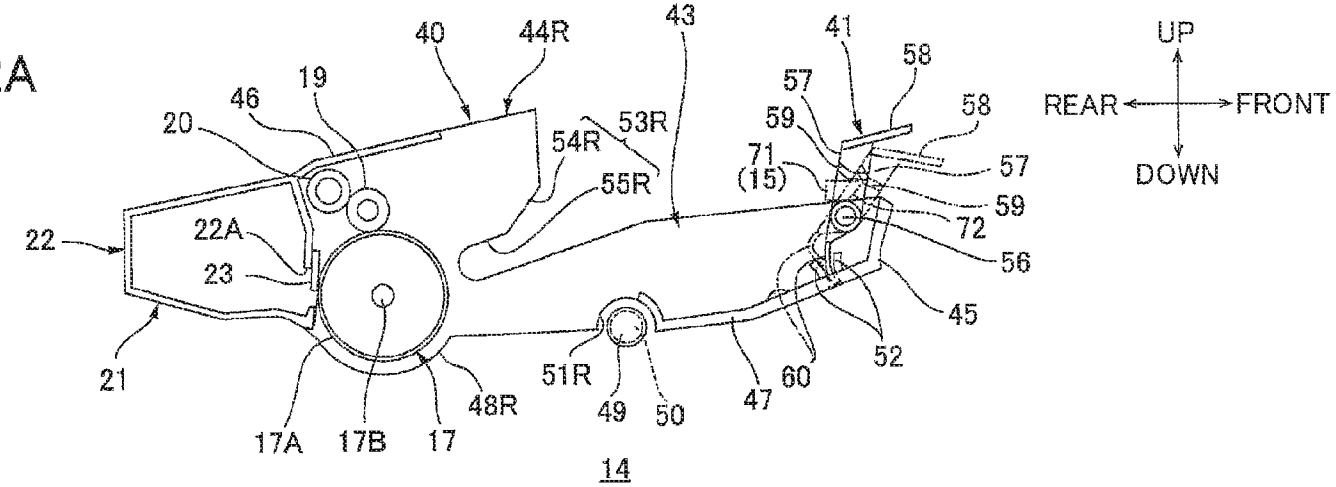
FIG. 2A is a cross-sectional side view of a drum cartridge constituting a process cartridge attachable to a housing of the image-forming apparatus according to the first embodiment illustrated in FIG. 1.
Figure 2B:
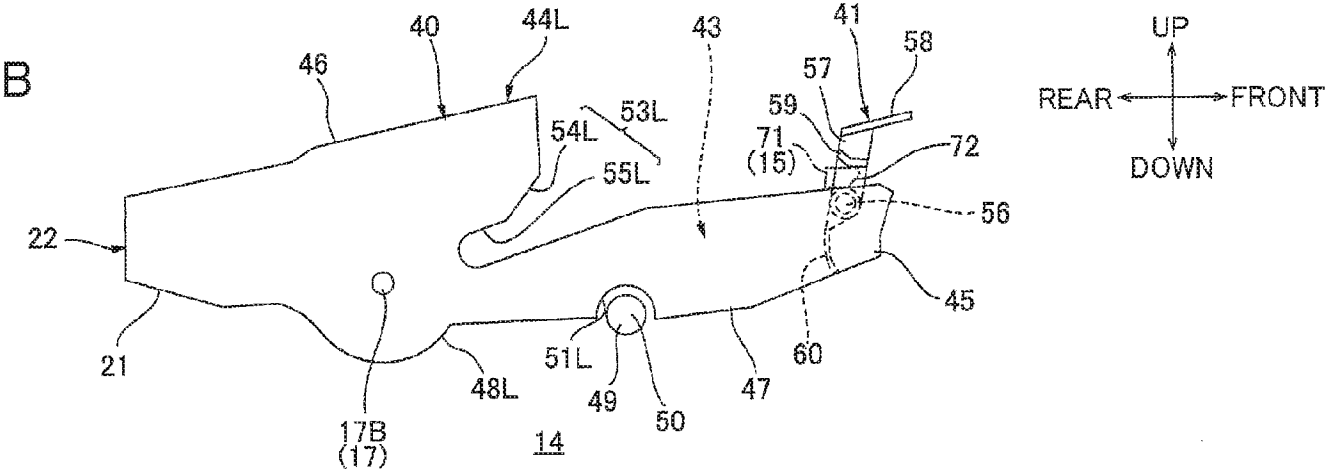
FIG. 2B is a side view of the drum cartridge shown in FIG. 2A.

As illustrated in FIGS. 2A and 2B, the drum cartridge 14 includes a drum frame 40 that supports the above-mentioned photosensitive drum 17, the second conveying roller 49, the above-mentioned cleaning unit 21, and a switching member 41.

(1-1) Drum Frame and Second Conveying Roller

The drum frame 40 includes a right side wall 44R having a concave part 51R and a groove part 53R, a left side wall 44L having a concave part 51L and a groove part 53L, a front wall 45, an upper wall 46, and a lower wall 47.

As illustrated in FIG. 2A, the right side wall 44R constitutes a right end portion of the drum frame 40. The right side wall 44R extends in the front-rear direction and vertical direction. The right side wall 44R also includes a convex part 48R and a stopper 52.

The convex part 48R is positioned at a rear end portion of the right side wall 44R in the front-rear direction. Specifically, the convex part 48R protrudes downward from a lower end edge of the right side wall 44R, and has a substantially semicircular shape in a side view (as viewed in the left-right direction). The convex part 48R overlaps the photosensitive drum 17 when viewed in the left-right direction. The convex part 48R has a lower end portion that is positioned below a lower end portion of the photosensitive drum 17.

The stopper 52 is positioned at a front end portion of the right side wall 44R. Specifically, the stopper 52 protrudes inward in the left-right direction from an inner surface (left surface) of the front end portion the right side wall 44R. The stopper 52 is constituted of a pair of plate-like parts facing each other in the front-rear direction.

The concave part 51R is positioned at substantially the center of the right side wall 44R in the front-rear direction. The concave part 51R is recessed upward from the lower end edge of the right side wall 44R. The concave part 51R has a substantially semicircular shape when viewed in the left-right direction.

The groove part 53R is positioned at substantially the center of the right side wall 44R in the front-rear direction. The groove part 53R extends in the front-rear direction and is opened frontward. The groove part 53R is positioned forward of the photosensitive drum 17. The groove part 53R includes a wide part 54R and a narrow part 55R.

The wide part 54R constitutes a frontward portion of the groove part 53R. The wide part 54R is tapered toward the rear side.

The narrow part 55R extends rearward continuously from a rear end of the wide part 54R. That is, the narrow part 55R constitutes a rearward portion of the groove part 53R. The narrow part 55R has a constant width.

As illustrated in FIG. 2B, the left side wall 44L constitutes a left end portion of the drum frame 40. The left side wall 44L has the same shape as the right side wall 44R. That is, the left side wall 44L is formed with the groove part 53L that includes a wide part 54L and a narrow part 55L.

As illustrated in FIG. 2A, the front wall 45 constitutes a front end portion of the drum frame 40. The front wall 45 extends in the left-right direction to connect the right side wall 44R and the left side wall 44L. The front wall 45 also extends in the vertical direction.

The upper wall 46 constitutes an upper end portion of the drum frame 40. The upper wall 46 is arranged to connect the right side wall 44R and the left side wall 44L in the left-right direction. The upper wall 46 extends in the front-rear direction. The upper wall 46 is arranged to overlap the photosensitive drum 17, charging roller 19, and charged cleaning roller 20 in the vertical direction.

The lower wall 47 constitutes a lower end portion of the drum frame 40. The lower wall 47 is positioned forward of the concave part 51R and the concave part 51L. The lower wall 47 is arranged to connect the right side wall 44R and the left side wall 44L in the left-right direction. The lower wall 47 extends in the front-rear direction.

In the drum frame 40, a region located forward of the photosensitive drum 17 is defined as a developing-cartridge attachment part 43 to which the developing cartridge 15 is attachable.

Figure 4:
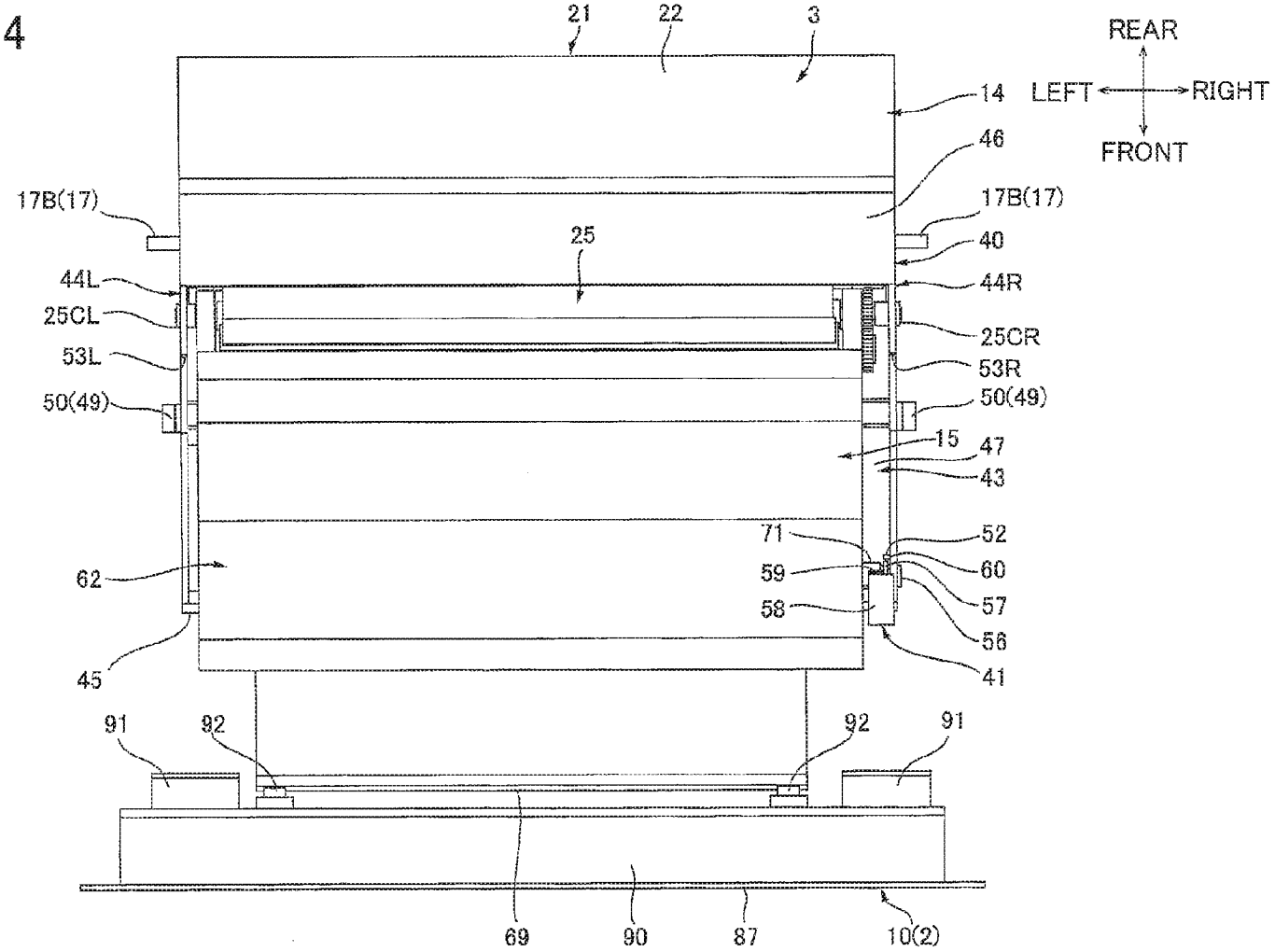
FIG. 4 is a plan view of the process cartridge illustrated in FIG. 3.

As illustrated in FIG. 2A and FIG. 4, the second conveying roller 49 is arranged at a position substantially center of the drum cartridge 14 in the front-rear direction. As illustrated in FIG. 1, the second conveying roller 49 is positioned upward of the first conveying roller 16 to be in contact therewith the same. As illustrated in FIG. 2A, the second conveying roller 49 is disposed to be received in the concave part 51R and concave part 51L. The second conveying roller 49 extends in the left-right direction. The second conveying roller 49 has a substantially columnar shape. The second conveying roller 49 is rotatably supported by the drum frame 40. Specifically, as illustrated in FIG. 4, the second conveying roller 49 is supported by the drum frame 40 such that a right end portion of the second conveying roller 49 protrudes rightward from the right side wall 44R, whereas a left end portion of the second conveying roller 49 protrudes leftward from the left side wall 44L. Each of the right and left end portions of the second conveying roller 49 constitutes a protruding part 50.

(1-2) Photosensitive Drum

The photosensitive drum 17 includes a cylindrical part 17A and a drum shaft 17B. The cylindrical part 17A is provided over the drum shaft 17B, as shown in FIG. 2A.

Specifically, the cylindrical part 17A constitutes an outer periphery of the photosensitive drum 17 in a radial direction thereof. The cylindrical part 17A extends in the left-right direction. The cylindrical part 17A has a cylindrical shape whose both end portions in the left-right direction are closed. The cylindrical part 17A has a peripheral surface coated with a photosensitive layer.

The drum shaft 17B is positioned at the center of the photosensitive drum 17 in the radial direction thereof. The drum shaft 17B extends in the left-right direction. That is, the photosensitive drum 17 defines an axis extending in an axial direction parallel to the left-right direction. The drum shaft 17B has a columnar shape. As illustrated in FIG. 4, the drum shaft 17B has a right end portion that is rotatably supported by the right side wall 44R and that protrudes rightward from the right side wall 44R. The drum shaft 17B has a left end portion that is rotatably supported by the left side wall 44L and that protrudes leftward from the left side wall 44L.

(1-3) Cleaning Unit

As illustrated in FIG. 2A, the cleaning unit 21 is positioned rearward of the photosensitive drum 17. The cleaning unit 21 includes a waste toner container 22 formed with an opening 22A and a cleaning member 23.

The waste toner container 22 has a hollow cylindrical shape extending in the left-right direction. The waste toner container 22 has a right end portion that is closed by the rear end portion of the right side wall 44R. Likewise, the waste toner container 22 has a left end portion that is closed by the rear end portion of the left side wall 44L.

The opening 22A is formed in a front wall of the waste toner container 22. The opening 22A penetrates the front wall of the waste toner container 22 in the front-rear direction.

The cleaning member 23 is a cleaning blade. The cleaning member 23 has a plate-like shape. The cleaning member 23 is fixed to an upper periphery of the opening 22A on the front wall of the waste toner container 22. The cleaning member 23 has a lower end portion in contact with a rear part of the peripheral surface of the photosensitive drum 17.

In the cleaning unit 21, the cleaning member 23 is configured to scrape extraneous matters adhered to the peripheral surface of the photosensitive drum 17, and the scraped extraneous matters are collected and stored in the waste toner container 22 through the opening 22A.

(1-4) Switching Member

The switching member 41 functions to switch mounted states of the process cartridge 3, i.e., control attachment and detachment of the developing cartridge 15 relative to the drum cartridge 14. Specifically, the switching member 41 can restrict the developing cartridge 15 attached to the drum cartridge 14 from being detached therefrom, whereas the switching member 41 can also release the restriction thereof on the attached developing cartridge 15 and allow detachment of the developing cartridge 15 from the drum cartridge 14.

The switching member 41 is provided at the front end portion of the drum cartridge 14. Specifically, the switching member 41 is movably supported by the drum frame 40. The switching member 41 is pivotable about an axis of the shaft part 56 between a restriction position (solid line in FIG. 2A) and a non-restriction position (double-dotted chain line in FIG. 2A). In the following description of the switching member 41, the switching member 41 is assumed to be situated at the restriction position.

The switching member 41 includes a shaft part 56, an operation part 58, a connection part 57, a second protrusion 59, and a flexible part 60.

The shaft part 56 has a columnar shape extending in the left-right direction. The shaft part 56 is rotatably supported by the right side wall 44R at a position farther away from the photosensitive drum 17 than the stopper 52 is from the photosensitive drum 17 in the front-rear direction.

The operation part 58 constitutes an upper end portion of the switching member 41. The operation part 58 is operated by a user to move the switching member 41 from the restriction position (solid line in FIG. 2A) to the non-restriction position (double-dotted chain line in FIG. 2A). The operation part 58 has a plate-like shape and extends in the left-right direction and front-rear direction.

The connection part 57 connects the shaft part 56 and the operation part 58. The connection part 57 has a plate-like shape, and extends in the front-rear direction and vertical direction.

The second protrusion 59 is provided on the connection part 57 between the shaft part 56 and the operation part 58. Specifically, the second protrusion 59 protrudes inward in the left-right direction from an inner surface (left surface) of the connection part 57. The second protrusion 59 has a plate-like shape, and extends in the front-rear direction and left-right direction. The second protrusion 59 has a rear end portion that is bent upward toward the rear. The second protrusion 59 and the shaft part 56 define a vertical distance therebetween that is substantially the same as a vertical dimension of a first protrusion 71 (described later) of the developing cartridge 15.

The flexible part 60 extends downward from a lower end portion of the shaft part 56. The flexible part 60 is rod-like shaped and has flexibility. The flexible part 60 has a tip end portion adapted to be interposed between the pair of plate-like parts constituting the stopper 52 of the right side wall 44R.

(2) Developing Cartridge

Figure 3:
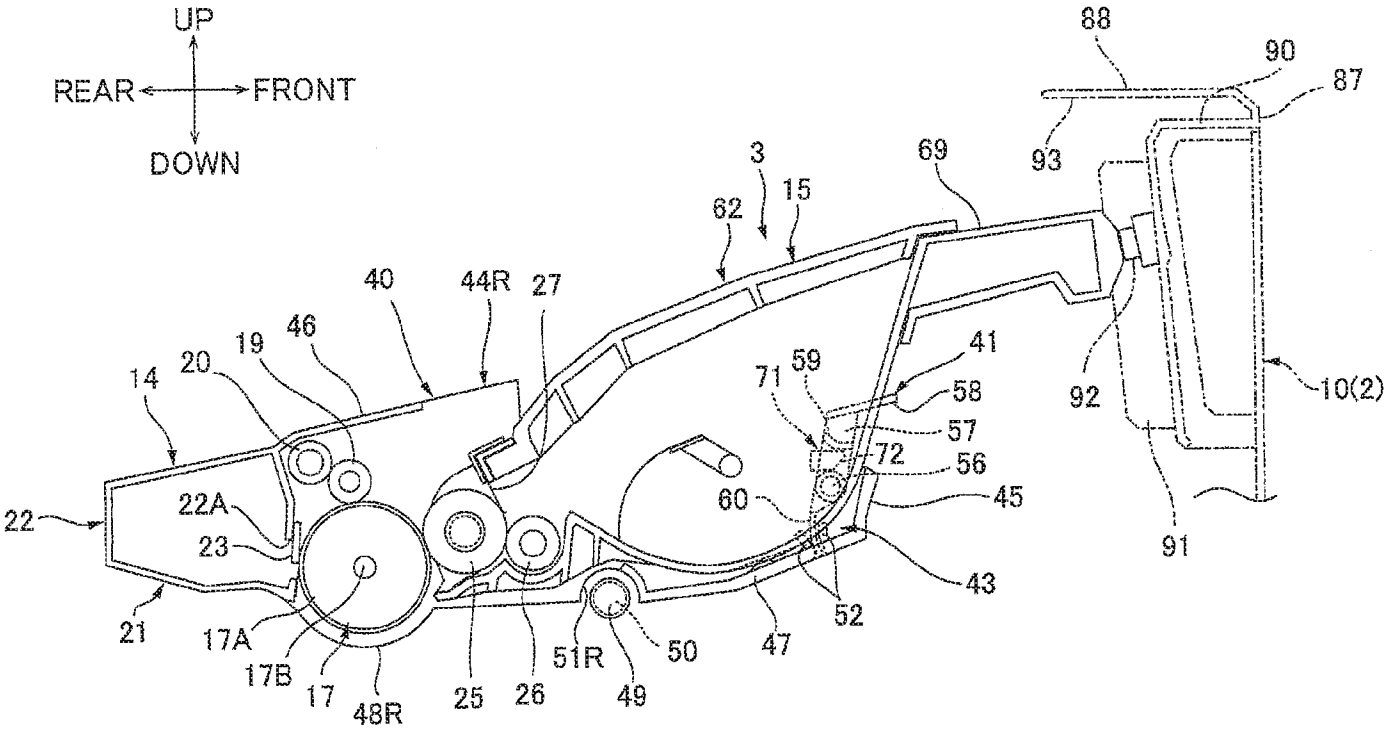
FIG. 3 is a cross-sectional side view of the process cartridge attachable to the housing of the image-forming apparatus according to the first embodiment shown in FIG. 1.

As illustrated in FIG. 3, the developing cartridge 15 includes the developing frame 62 and a handle 69. The developing frame 62 supports the above-described developing roller 25 and supply roller 26.

(2-1) Developing Frame and Handle

The developing frame 62 has a substantially box shape. The developing frame 62 includes the first protrusion 71 described above.

The first protrusion 71 is provided at a front end portion of the developing frame 62. Specifically, the first protrusion 71 protrudes rightward from a right surface of the front end portion of the developing frame 62. The first protrusion 71 has a substantially rectangular columnar shape.

The first protrusion 71 has a front end portion formed with a slope 72. The slope 72 is sloped upward toward the front.

The handle 69 is positioned at the front end portion of the developing cartridge 15. Specifically, the handle 69 extends frontward from an upper end portion of a front wall constituting the developing frame 62. As illustrated in FIG. 4, the handle 69 extends in the left-right direction. The handle 69 has a substantially rectangular cylindrical shape. The handle 69 has a left-right dimension that is smaller than that of the developing frame 62. As illustrated in FIG. 1, when the developing cartridge 15 is mounted in the housing 2, the handle 69 is positioned closer to the cover 10 than the front end portion of the drum cartridge 14 is to the cover 10.

(2-2) Developing Roller

The developing roller 25 extends in the left-right direction. The developing roller 25 has a columnar shape. The developing roller 25 is rotatably supported by the developing frame 62. As illustrated in FIG. 4, the developing roller 25 includes a shaft extending in the left-right direction, a right-side developing collar 25CR and a left-side developing collar 25CL.

The right-side developing collar 25CR is positioned at a right end of the developing roller 25. The developing collar 25CR is fitted to a right end of the shaft of the developing roller 25. The developing collar 25CR has a cylindrical shape, and extends in the left-right direction. The developing collar 25CR is positioned rightward of the developing frame 62, as shown in FIG. 4. Specifically, the developing collar 25CR is fitted to the narrow part 55R constituting the groove part 53R of the right side wall 44R of the drum frame 40.

The developing collar 25CL is positioned at a left end of the developing roller 25. The developing collar 25CL is fitted to a left end of the shaft of the developing roller 25. The developing collar 25CL has a cylindrical shape, and extends in the left-right direction. The developing collar 25CL is positioned leftward of the developing frame 62, as shown in FIG. 4. The developing collar 25CL is fitted to the narrow part 55L constituting the groove part 53L of the left side wall 44L of the drum frame 40.

When the developing cartridge 15 is attached to the drum cartridge 14, the developing roller 25 is positioned forward of the photosensitive drum 17 and in contact therewith (see FIGS. 1 and 3).

(2-3) State of the Developing Cartridge Relative to the Drum Cartridge

As illustrated in FIG. 3, the developing cartridge 15 is attached to the developing cartridge attachment part 43 of the drum cartridge 14.

When the switching member 41 of the drum cartridge 14 is in the restriction position (solid line in FIG. 2A), the first protrusion 71 of the developing frame 62 is nipped between the shaft part 56 and the second protrusion 59 of the switching member 41 in the vertical direction. The first protrusion 71 nipped between the shaft part 56 and the second protrusion 59 restricts the front end portion of the developing frame 62 from being moved in the vertical direction.

In this way, when the switching member 41 of the drum cartridge 14 is at the restriction position, the second protrusion 59 of the switching member 41 is engaged with the first protrusion 71 of the developing frame 62 to restrict removal of the developing cartridge 15 from the drum cartridge 14.

When the switching member 41 is in the non-restriction position (double-dotted chain line in FIG. 2A), the second protrusion 59 of the switching member 41 is disengaged from the first protrusion 71 of the developing frame 62 and positioned above the shaft part 56. Accordingly, the switching member 41 in the non-restriction position no longer restricts upward movement of the developing frame 62, so that the developing cartridge 15 can be made detachable from the drum cartridge 14.

3. Details of the Housing

Figure 7:
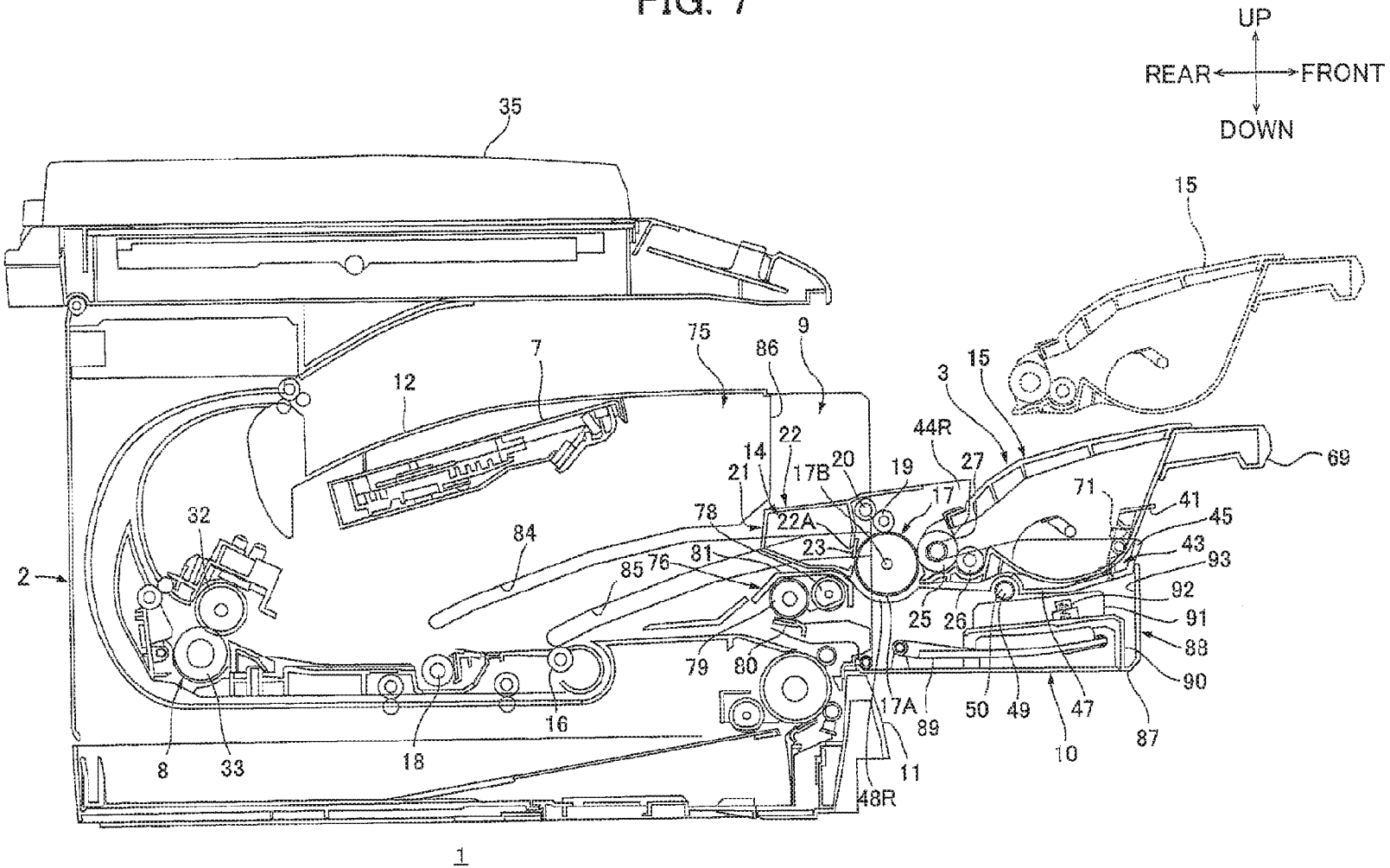
FIG. 7 is a view illustrating a state where the process cartridge of FIG. 5 is supported by the first support portion, a second support portion, and a third support portion of the housing of the image-forming apparatus according to the first embodiment.

As illustrated in FIGS. 1 and 7, the housing 2 includes two side walls 75 having grooves 84 and 85, a manual feed unit 76, and the above-mentioned cover 10.

(1) Side Walls

The two side walls 75 are positioned spaced apart from each other in the left-right direction. Since the right side wall 75 and the left side wall 75 have the same shape, a detailed description will be given only on the right side wall 75 hereinafter.

The side wall 75 is positioned at a right end portion of the housing 2. The side wall 75 extends in the vertical direction and front-rear direction. The side wall 75 has a plate-like shape.

The groove 84 is adapted to guide movement of the process cartridge 3. Specifically, at the time of insertion of the process cartridge 3 into the housing 2, the groove 84 functions to guide the photosensitive drum 17 of the process cartridge 3 (drum cartridge 14) down to a position above the transfer roller 18. The groove 84 is recessed outward in the left-right direction (rightward) from an inner surface (left surface) of the side wall 75. The groove 84 extends in the front-rear direction to connect the position above the transfer roller 18 and the opening part 9. The groove 84 has a constant width.

The groove 84 has a front end portion formed with an opened part 86. The opened part 86 extends upward from an upper surface of the front end portion defining the groove 84.

Figure 5:
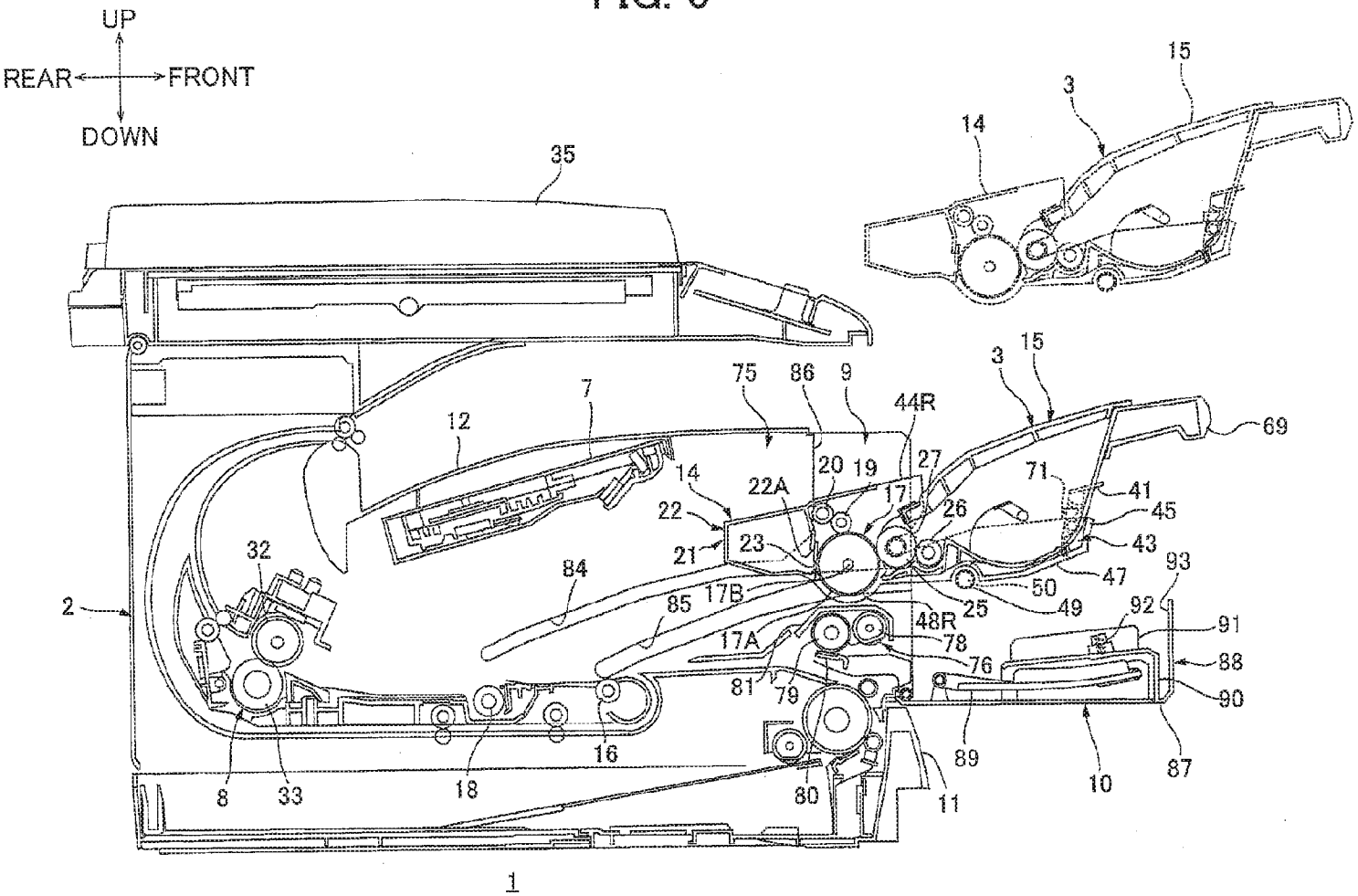
FIG. 5 is a view explaining attachment and detachment of the process cartridge relative to the housing of the image-forming apparatus illustrated in FIG. 1.

As illustrated in FIGS. 1 and 5, the groove 85 is formed below the groove 84. The groove 85 is also adapted to guide the movement of the process cartridge 3. Specifically, at the time of insertion of the process cartridge 3 into the housing 2, the groove 85 functions to guide the second conveying roller 49 of the process cartridge 3 (drum cartridge 14) down to a position above the first conveying roller 16. The groove 85 is recessed outward in the left-right direction (rightward) from the inner surface (left surface) of the side wall 75. The groove 85 extends to connect the position above the first conveying roller 16 and the opening part 9.

(2) Manual Feed Unit

As illustrated in FIG. 1, the manual feed unit 76 is used to form an image onto the sheet P supported on a manual feed tray 89 to be described later. The manual feed unit 76 is provided at a lower end portion of the opening part 9. The manual feed unit 76 includes conveying rollers 78 and 79, a conveying pad 80, and a first support part 81.

The conveying roller 78 is configured to rotate to convey the sheets P loaded on the manual feed tray 89 to a position between the conveying roller 79 and the conveying pad 80.

The conveying roller 79 and conveying pad 80 are configured to separate the sheets P one from another by rotation of the conveying roller 79. The conveying roller 79 is configured to convey each sheet P toward a position between the first conveying roller 16 and the second conveying roller 49.

Figure 6:
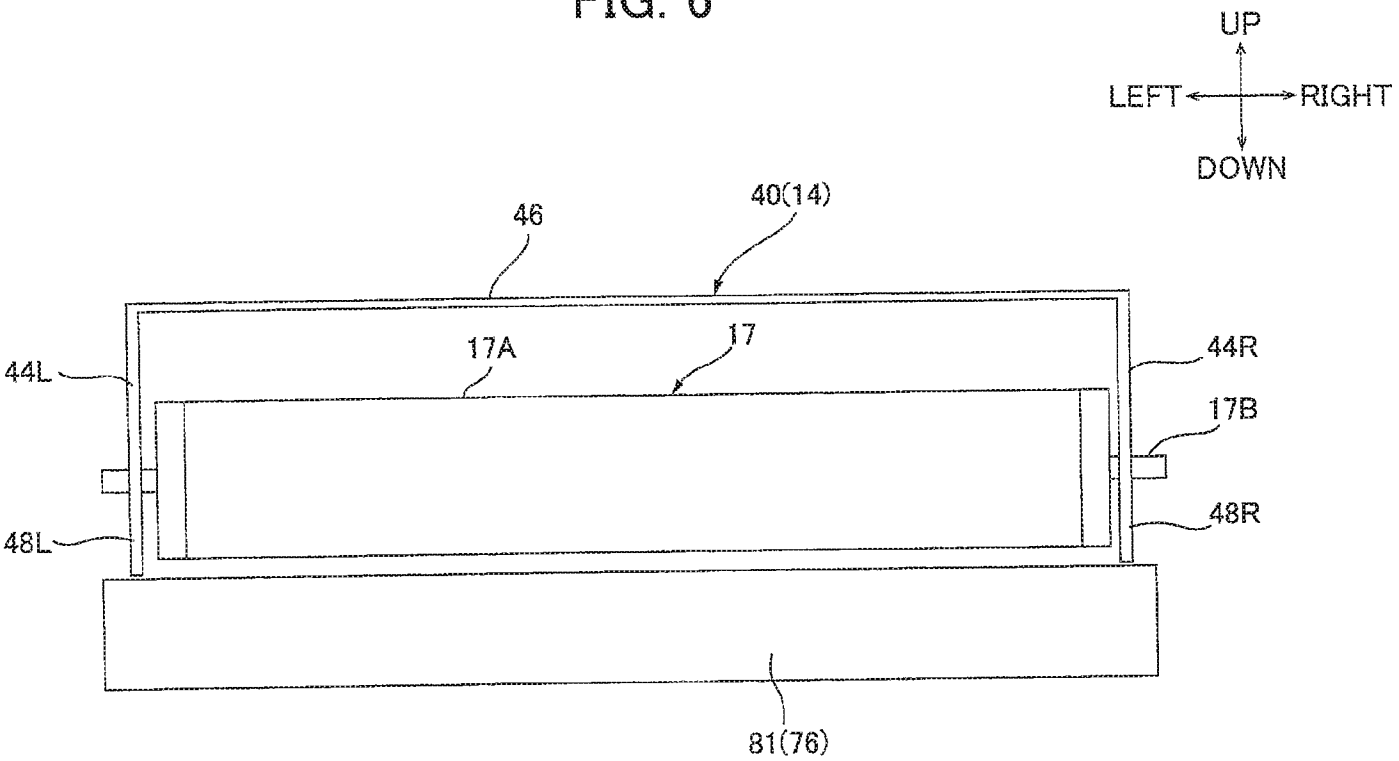
FIG. 6 is a front view of the process cartridge and a first support portion of the housing illustrated in FIG. 5.

The first support part 81 is a cover for protecting the conveying rollers 78 and 79. The first support part 81 is positioned above the conveying rollers 78 and 79 and below the groove 85. The first support part 81 has a substantially inverted U-shape when viewed in the left-right direction. The first support part 81 extends in the left-right direction. The first support part 81 has a plate-like shape. As illustrated in FIG. 6, the first support part 81 has a dimension in the left-right direction that is larger than an interval between the left and right side walls 44L and 44R in the left-right direction. That is, the first support part 81 (as an example of a first support part) includes a conveying-roller cover.

(3) Cover

The cover 10 is formed of a resin material. As illustrated in FIG. 5, the cover 10 includes a cover body 87, a second support part 88, two support tables 91, two pressing parts 92, and the manual feed tray 89. In the following description of the cover 10, the cover 10 is assumed to be at its opened position.

The cover body 87 extends in the front-rear direction and left-right direction. The cover body 87 has a generally plate-like shape. The cover body 87 has a rear end pivotably supported by the front end portion of the housing 2. The cover body 87 includes a main portion extending in the front-rear direction, the second support part 88, and a manual-tray housing part 90.

The second support part 88 extends upward from a front end portion of the major portion of the cover body 87. The second support part 88 constitutes a front end portion of the cover 10. The second support part 88 is disposed forward of the first support part 81 of the manual feed unit 76 and is spaced apart therefrom in the front-rear direction (an example of a first direction). A dimension between the second support part 88 and the front end of the first support part 81 is substantially the same as a dimension between the front end portion of the drum frame 40 and the rear end portions of the convex parts 48R and 48L of the drum frame 40 (see FIG. 7). The second support part 88 has a plate-like shape extending in the vertical direction and left-right direction. The second support part 88 has an upper end serving as a free end, while a lower end of the second support part 88 is connected to the front end portion of the major portion of the cover body 87. Accordingly, the second support part 88 is made resiliently deformable about its lower end connected to the front end portion of the major portion of the cover body 87.

The second support part 88 has a rear surface serving as a surface 93. That is, the surface 93 faces rearward when the cover 10 is at the opened position.

The manual-tray housing part 90 is provided rearward of the second support part 88. The manual-tray housing part 90 is recessed upward from an upper surface of the major portion of the cover body 87. The manual-tray housing part 90 has a substantially box-like shape having an open bottom. The manual feed tray 89 is adapted to be accommodated in the manual-tray housing part 90.

Figure 9:
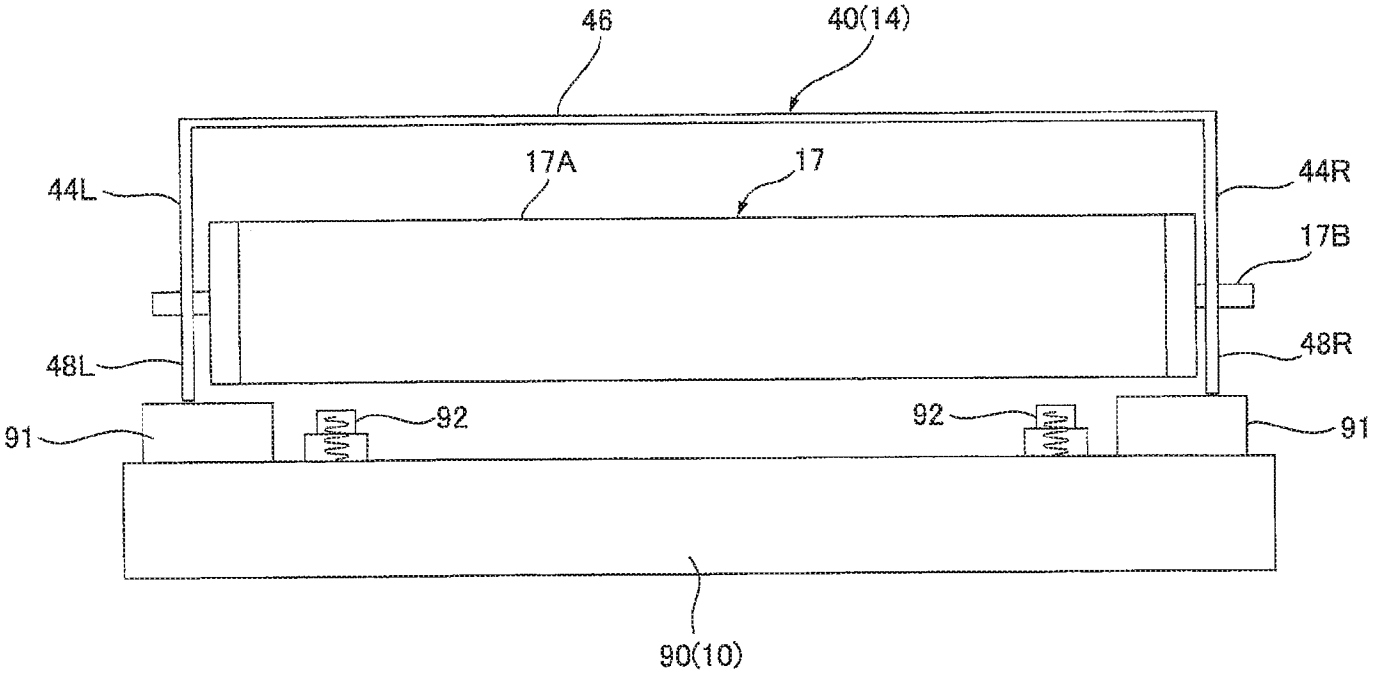
FIG. 9 is a front view of the process cartridge and a cover of the housing of the image-forming apparatus according to the first embodiment illustrated in FIG. 8.

The two support tables 91 are positioned on an upper surface of the manual-tray housing part 90. That is, the support tables 91 are positioned above the manual feed tray 89 in the vertical direction. The support tables 91 protrude upward from the upper surface of the manual-tray housing part 90. Each of the support tables 91 has a rectangular columnar shape and extends in the front-rear direction. As illustrated in FIG. 4, the two support tables 91 are positioned spaced apart from each other in the left-right direction. The two support tables 91 define a distance therebetween that is larger than the dimension of the handle 69 of the developing frame 62 in the left-right direction. Further, as illustrated in FIG. 9, outer ends of the two support tables 91 define a distance therebetween that is larger than an interval between the side walls 44R and 44L in the left-right direction. Inner ends of the two support tables 91 define a distance therebetween that is smaller than the interval between the side walls 44R and 44L in the left-right direction.

As illustrated in FIG. 5, the two pressing parts 92 are also positioned on the upper surface of the manual-tray housing part 90. That is, the pressing parts 92 are positioned above the manual feed tray 89 in the vertical direction. The pressing parts 92 have a substantially cylindrical shape with a closed upper end portion. The pressing parts 92 extend in the vertical direction. Each of the pressing parts 92 defines a hollow space thereinside in which a coil spring is accommodated. Each pressing part 92 has a lower end that contacts the upper surface of the manual-tray housing part 90. As illustrated in FIG. 9, the two pressing parts 92 are positioned spaced apart from each other in the left-right direction. The two pressing parts 92 define a distance therebetween that is smaller than the distance defined between the two support tables 91 in the left-right direction. Each pressing part 92 defines a vertical dimension smaller than a vertical dimension of each support table 91 when the coil spring inside each pressing part 92 has a natural length.

As illustrated in FIG. 5, the manual feed tray 89 is accommodated inside the manual-tray housing part 90. The manual feed tray 89 has a plate-like shape extending in the front-rear direction. The manual feed tray 89 has a rear end portion pivotably supported by the cover body 87 so that the manual feed tray 89 can pivot relative to the cover body 87 about the rear end portion of the manual feed tray 89.

4. Arrangement of Process Cartridge Attached to Housing

As illustrated in FIG. 1, when the process cartridge 3 has been attached to the housing 2, the process cartridge 3 as a whole is positioned within an inner space of the housing 2 inward of the opening part 9. In other words, the inner space of the housing 2 is located frontward of the opening part 9.

The inner space of the housing 2 is a space for detachably accommodating the process cartridge 3 therein. Specifically, the inner space of the housing 2 is a space defined between the scanner unit 7 and the transfer roller 18 in the vertical direction, and between the fixing unit 8 and the cover 10 at the closed position in the front-rear direction.

Lateral end portions of the drum shaft 17B are respectively fitted to rear end portions of the grooves 84 formed in the side walls 75.

The photosensitive drum 17 is positioned upward of the transfer roller 18. The photosensitive drum 17 is in contact with the transfer roller 18.

The protruding parts 50 (left and right end portions) of the second conveying roller 49 are respectively fitted to rear end portions of the grooves 85 of the side walls 75.

The second conveying roller 49 is positioned upward of the first conveying roller 16. The second conveying roller 49 is in contact with the first conveying roller 16.

That is, when the process cartridge 3 has been attached to the housing 2, the photosensitive drum 17 and the transfer roller 18 are in contact with each other and the second conveying roller 49 and the first conveying roller 16 are in contact with each other. This state shown in FIG. 1 is called an attachment state of the process cartridge 3 relative to the housing 2.

When the process cartridge 3 has been mounted in the housing 2 and the cover 10 is closed, as illustrated in FIGS. 3 and 4, a front end portion of the handle 69 is in contact with the rear ends of the respective pressing parts 92 of the cover 10 at the closed position. In this state, the pressing parts 92 urge the developing cartridge 15 toward the drum cartridge 14 when the cover 10 is at the closed position. That is, the developing cartridge 15 is pressed rearward by the cover 10 through the pressing parts 92, and the developing roller 25 is pressed toward the photosensitive drum 17 of the drum cartridge 14.

The two support tables 91 of the cover 10 at the closed position are separated from the process cartridge 3.

5. Attachment/Detachment of Developing Cartridge (1) Detachment of Developing Cartridge For detaching the developing cartridge 15 from the drum cartridge 14, first of all, a user sets the cover 10 of the housing 2 to the opened position as illustrated in FIG. 5.

When the cover 10 is moved to the opened position, the second support part 88 of the cover 10 is positioned forward of the first support part 81 and is spaced apart therefrom in the front-rear direction. At this time, the surface 93 of the second support part 88 faces rearward.

The user then grips the handle 69 and pulls out the process cartridge 3 generally forward.

In accordance with withdrawal of the process cartridge 3, the protruding parts 50 of the second conveying roller 49 are moved toward the opening part 9 along the grooves 85 of the side walls 75.

At this time, the lateral end portions of the drum shaft 17B of the photosensitive drum 17 are also moved toward the opening part 9 along the grooves 84 of the side walls 75.

As illustrated in FIGS. 5 and 6, during the withdrawal of the process cartridge 3, the photosensitive drum 17 passes above and moves past the first support part 81 of the manual feed unit 76.

At this time, the convex parts 48R and 48L of the right and right side walls 44R and 44L are brought closer to the first support part 81 than the photosensitive drum 17 is.

Then, as illustrated by phantom lines in FIG. 7, the process cartridge 3 is detached from the housing 2. The user subsequently places the detached process cartridge 3 on the first support part 81, second support part 88, and two support tables 91.

Specifically, the user places the waste toner container 22 constituting the cleaning unit 21 of the drum frame 40 on the first support part 81. That is, the first support part 81 supports the rear end portion of the drum frame 40.

At this time, the convex parts 48R and 48L of the right and right side walls 44R and 44L abut on the front end portion of the first support part 81.

The user further brings the front end portion of the drum frame 40 into contact with the surface 93 of the second support part 88 of the cover 10, while resiliently deforming the surface 93. Thus, the drum frame 40 is restricted from being moved forward by the surface 93. That is, the second support part 88 supports the front end portion of the drum frame 40. At this time, due to the resilient deformation of the second support part 88, the drum frame 40 can be reliably held between the second support part 88 and the first support part 81.

Thus, as shown in FIG. 7, when the drum frame 40 is supported by the first support part 81 and second support part 88, a part of the drum frame 40 (a portion from the convex parts 48R and 48L to the front end portion of the lower wall 47 in the front-rear direction) is positioned between the first support part 81 and the second support part 88. That is, the drum frame 40 is held (interposed) between the first support part 81 and the second support part 88.

At this time, the lower end portion of the drum frame 40 (lower wall 47) is in contact with the two support tables 91 of the cover 10 between the cleaning unit 21 and the front wall 45. That is, the two support tables 91 support the lower end portion of the drum frame 40.

In this way, the process cartridge 3 is sandwiched (nipped) between the first support part 81 and the second support part 88 while being supported on the two support tables 91. The process cartridge 3 is thus fixed to the housing 2 by the first support part 81 and cover 10.

At this time, the front end portion of the process cartridge 3 is positioned outside the opening part 9 of the housing 2. Specifically, the switching member 41 of the drum cartridge 14 and the handle 69 of the developing cartridge 15 are positioned outside the opening part 9 of the housing 2.

Further, at this time, the photosensitive drum 17 is spaced from the transfer roller 18. The rear end portion of the photosensitive drum 17 is positioned in the inner space of the housing 2.

Further, the two pressing parts 92 of the cover 10 are separated from the process cartridge 3 in the vertical direction (an example of a second direction).

Once the process cartridge 3 has been fixed to the housing 2, the user then removes the developing cartridge 15 from the drum cartridge 14.

To detach the developing cartridge 15 from the drum cartridge 14, the user operates the operation part 58 to cause the switching member 41 to pivot about the axis of the shaft part 56 in the clockwise direction when viewed from the left side, as illustrated in FIG. 2A. That is, the switching member 41 is moved from the restriction position to the non-restriction position.

In the non-restriction, as indicated by a virtual line of FIG. 2A, the connection part 57 of the switching member 41 abuts against the upper end portion of the front wall 45 of the drum cartridge 14. The second protrusion 59 is positioned forward of the first protrusion 71. The lower end portion of the flexible part 60 of the switching member 41 is deformed while being in contact with the upper end portion of the stopper 52.

Subsequently, the user grips the handle 69 to pull out the developing cartridge 15 while the switching member 41 is at the non-restriction position. The developing cartridge 15 can be thus detached from the drum cartridge 14 fixed to the housing 2, as illustrated in FIG. 7.

That is, when the developing cartridge 15 has been detached, the drum cartridge 14 remains fixed to the housing 2. Once the developing cartridge 15 has been removed from the drum cartridge 14, the switching member 41 moves back to the restriction position due to a resilient force of the flexible part 60.

(2) Attachment of Developing Cartridge

For attaching the developing cartridge 15 to the drum cartridge 14, the user first attaches the developing cartridge 15 to the drum cartridge 14 fixed to the housing 2, as illustrated in FIG. 7.

Specifically, the developing cartridge 15 is inserted into the developing-cartridge attachment part 43 of the drum cartridge 14.

During insertion of the developing cartridge 15, the slope 72 of the first protrusion 71 of the developing cartridge 15 is brought into abutment with the second protrusion 59 of the switching member 41 at the restriction position from above. As a result, as illustrated in FIG. 2A, the switching member 41 is pivoted about the axis of the shaft part 56 in the clockwise direction when viewed from the left side.

When the first protrusion 71 has moved below the second protrusion 59, due to the resilient force of the flexible part 60, the switching member 41 is pivoted back in the counterclockwise direction when viewed from the left side.

The first protrusion 71 is thus positioned between the second protrusion 59 and the shaft part 56. When the second protrusion 59 has been engaged with the first protrusion 71, attachment of the developing cartridge 15 to the drum cartridge 14 is completed.

Subsequently, the user grips the handle 69 to lift up the process cartridge 3, as illustrated in FIG. 5, and then pushes the process cartridge 3 into the housing 2, as illustrated in FIG. 1. The user finally moves the cover 10 to the closed position.

6. Attachment/Detachment of Process Cartridge

The process cartridge 3 is detached from the housing 2 when the drum cartridge 14 is replaced with a new one or when jamming of the sheet P occurs.

To remove the process cartridge 3 from the housing 2, the user grips the handle 69 of the process cartridge 3 attached to the housing 2, and pulls out the process cartridge 3 in the front-rear direction, as illustrated in FIG. 5.

The process cartridge 3 is thus detached from the housing 2.

Further, the process cartridge 3 can also be detached from the state shown in FIG. 7, i.e., from the state where the process cartridge 3 is supported on the first support part 81, second support part 88, and two support tables 91.

Figure 8:
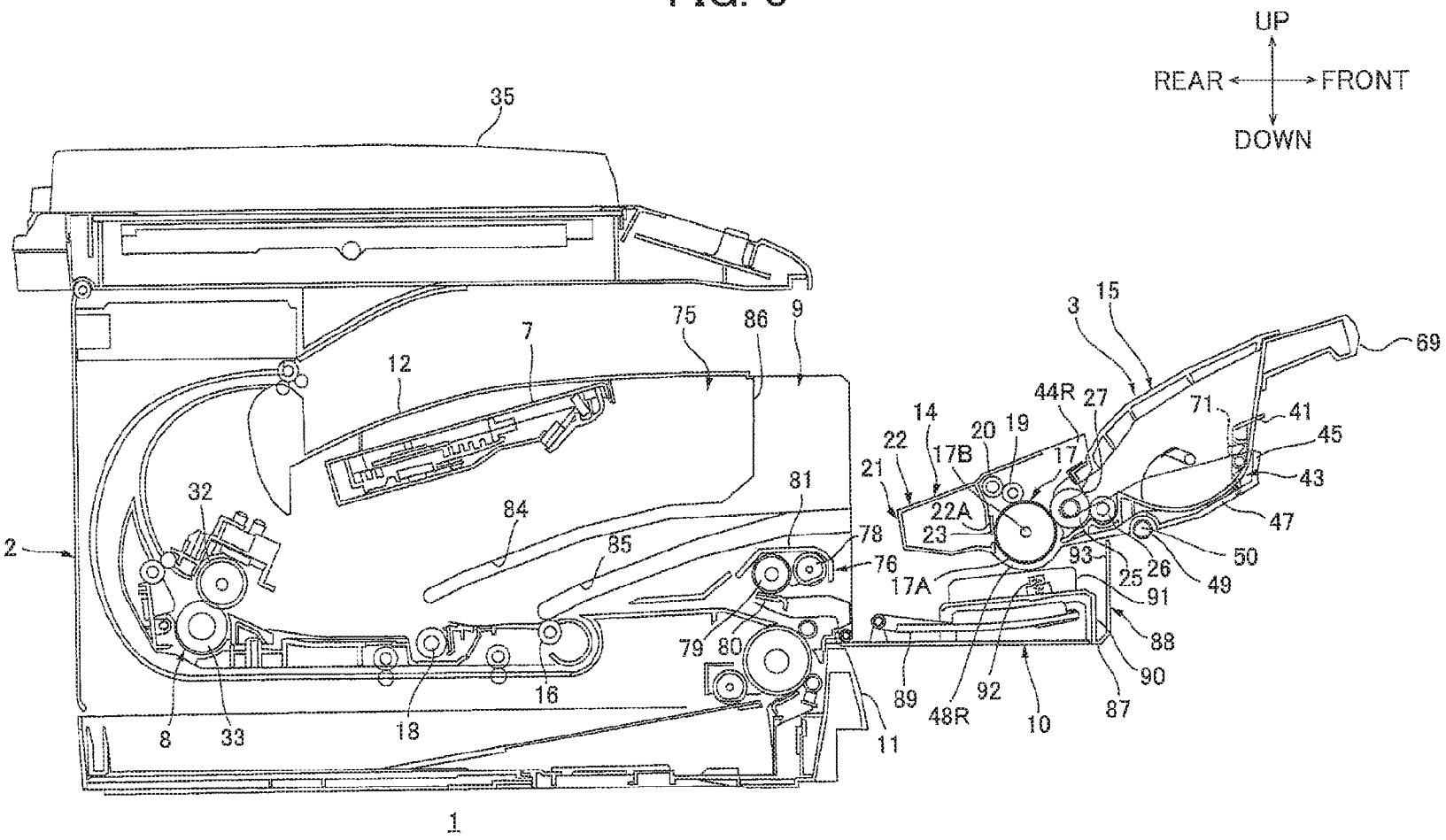
FIG. 8 is a view explaining attachment and detachment of the process cartridge in the state of FIG. 7 relative to the housing of the image-forming apparatus according to the first embodiment.

Specifically, the user grips the handle 69 to pull out the process cartridge 3 such that the abutment of the drum frame 40 against the surface 93 is released, as illustrated in FIG. 8.

At this time, the photosensitive drum 17 may be brought close to the cover 10, as shown in FIG. 9. However, the convex part 48R comes closer to the right support table 91 than the photosensitive drum 17 does, and the convex part 48L comes closer to the left support table 91 than the photosensitive drum 17 does. Therefore, the cylindrical part 17A of the photosensitive drum 17 is prevented from making contact with the cover 10.

In this way, the process cartridge 3 is detached from the housing 2.

In order to attach the process cartridge 3 to the housing 2, the user pushes the process cartridge 3 into the housing 2 through the opening part 9. The process cartridge 3 is thus accommodated in the housing 2, as illustrated in FIG. 1.

7. Operational and Technical Advantages (1) According to the image-forming apparatus 1 of the first embodiment, as illustrated in FIG. 7, the first support part 81 of the housing 2 supports the rear end portion of the drum frame 40 of the process cartridge 3 that has been detached from the housing 2. Further, the second support part 88 of the cover 10 supports the front end portion of the drum frame 40 of the process cartridge 3 that has been detached from the housing 2.

Further, the surface 93 of the second support part 88 can restrict the drum frame 40 of the process cartridge 3 from being moved frontward.

Thus, the process cartridge 3 can be reliably fixed by the housing 2 and cover 10.

As a result, the developing cartridge 15 can be easily attached to and detached from the drum cartridge 14 for replacement, with the drum cartridge 14 fixed to the housing 2.

(2) According to the image-forming apparatus 1, as illustrated in FIG. 7, the portion of the drum frame 40 from the convex parts 48R and 48L to the front end portion of the lower wall 47 is held between the first support part 81 and the second support part 88.

This structure can reliably restrict forward movement of the process cartridge.

(3) According to the image-forming apparatus 1, as illustrated in FIG. 7, the process cartridge 3 is supported on the first support part 81 and second support part 88, with the switching member 41 positioned outside the opening part 9 of the housing 2.

The user therefore can easily operate the switching member 41.

Accordingly, this structure can facilitate attachment/detachment of the developing cartridge 15 relative to the drum cartridge 14 for replacement while the process cartridge 3 is stably supported on the first support part 81 and second support part 88.

(4) According to the image-forming apparatus 1, as illustrated in FIGS. 2A and 3, the switching member 41 is mounted to the drum frame 40, so that the developing cartridge 15 set in the drum cartridge 14 can reliably be restricted from being detached from the drum cartridge 14.

(5) According to the image-forming apparatus 1, as illustrated in FIG. 7, the process cartridge 3 is supported on the first support part 81 and second support part 88 with the handle 69 positioned outside the opening part 9 of the housing 2.

The user therefore can easily operate the handle 69.

As a result, the user can grip the handle 69 while the process cartridge 3 is stably supported on the first support part 81 and second support part 88, and perform attachment/detachment of the developing cartridge 15 relative to the drum cartridge 14 as well as detachment of the process cartridge 3 from the housing 2.

(6) According to the image-forming apparatus 1, as illustrated in FIG. 7, the process cartridge 3 is supported not only on the first support part 81 and second support part 88, but also on the two support tables 91 of the cover 10.

Thus, the process cartridge 3 detached from the housing 2 can be fixed more reliably by the housing 2 and cover 10.

(7) According to the image-forming apparatus 1, as illustrated in FIG. 7, the two support tables 91 support the process cartridge 3 at a position between the rear end portion and the rear end portion of the process cartridge 3 in the front-rear direction, with the rear end portion supported on the first support part 81, and with the front end portion supported on the second support part 88.

Thus, the process cartridge 3 is fixed further stably by the housing 2 and cover 10.

(8) According to the image-forming apparatus 1, as illustrated in FIGS. 1 and 4, the two support tables 91 are separated from the process cartridge 3 when the process cartridge 3 is attached to the housing 2 and the cover 10 is at the closed position.

Thus, the two support tables 91 do not apply unnecessary force to the process cartridge 3, realizing stable image forming operations.

(9) According to the image-forming apparatus 1, as illustrated in FIGS. 1 and 4, when the cover 10 is at the closed position, the two pressing parts 92 press the developing cartridge 15 of the process cartridge 3 accommodated in the housing 2 toward the photosensitive drum 17.

The developing roller 25 can make contact with the photosensitive drum 17 reliably, and as a result, toner can be supplied to the photosensitive drum 17 without fail.

Further, as illustrated in FIG. 7, when the cover 10 is at the opened position, the two pressing parts 92 are separated from the process cartridge 3. The process cartridge 3 can be reliably supported by the first support part 81, second support part 88, and two support tables 91.

(10) According to the image-forming apparatus 1, as illustrated in FIG. 7, when the cover 10 is at the opened position and the process cartridge 3 is supported on the first support part 81 and second support part 88, the pressing parts 92 are positioned below the process cartridge 3 so as to be spaced apart therefrom.

Thus, the process cartridge 3 is reliably supported on the first support part 81, second support part 88, and two support tables 91.

(11) According to the image-forming apparatus 1, the cover 10 is provided with both the two support tables 91 and two pressing parts 92 as illustrated in FIGS. 1 and 4. The two support tables 91 can not only support the process cartridge 3 detached from the housing 2 when the cover 10 is at the opened position as illustrated in FIG. 7, but also press the developing cartridge 15 of the process cartridge 3 attached to the housing 2 when the cover 10 is at the closed position, as illustrated in FIGS. 3 and 4.

(12) According to the image-forming apparatus 1, as illustrated in FIG. 1, the first support part 81, which supports the process cartridge 3 detached from the housing 2, can also serve as a cover for covering the conveying rollers 78 and 79. This structure can realize reduction in the number of components.

(13) According to the image-forming apparatus 1, as illustrated in FIG. 7, the first support part 81 supports the waste toner container 22 of the cleaning unit 21 constituting the drum frame 40 without making contact with the photosensitive drum 17.

Thus, the photosensitive drum 17 can reliably be protected while the process cartridge 3 is supported on the first support part 81 and second support part 88.

Second Embodiment

Figure 10:
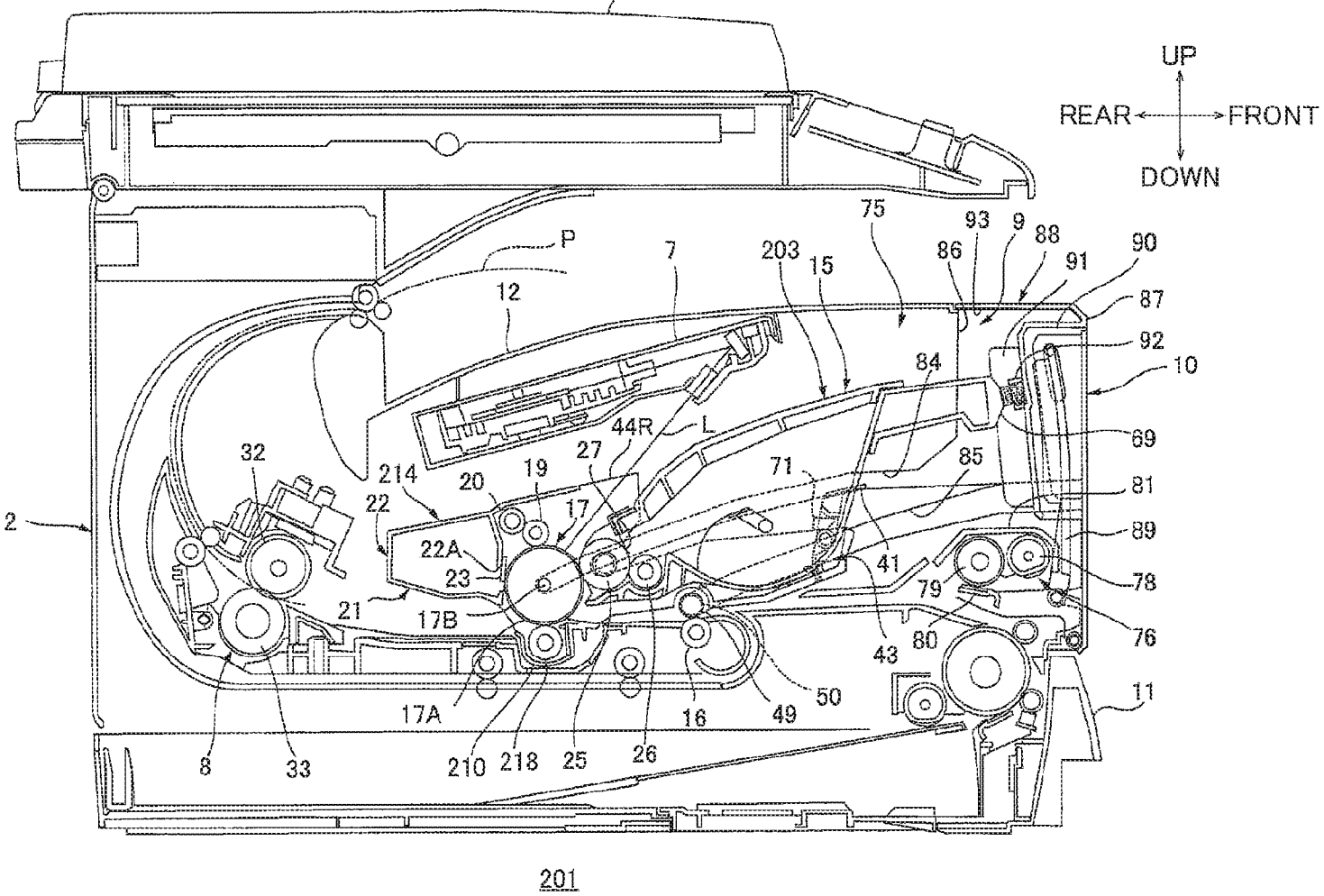
FIG. 10 is a cross-sectional side view of an image-forming apparatus according to a second embodiment, wherein a process cartridge according to the second embodiment is attached to a housing of the image-forming apparatus.

Next, an image-forming apparatus 201 according to a second embodiment will be described with reference to FIGS. 10 and 11. In the following description of the second embodiment, like parts and components are designated with the same reference numerals as those of the first embodiment to avoid duplicating explanation.

In the above-described first embodiment, the transfer roller 18 is provided in the housing 2, as illustrated in FIG. 7. On the other hand, a transfer roller 218 of the second embodiment is provided in a transfer-roller housing part 210 of a drum cartridge 214, as illustrated in FIGS. 10 and 11.

Specifically, the transfer-roller housing part 210 is positioned at a rear end portion of the drum cartridge 214. The transfer-roller housing part 210 is positioned below the photosensitive drum 17 in the drum cartridge 214. The transfer-roller housing part 210 has a substantially U shape that is open upward when viewed in the left-right direction. The transfer-roller housing part 210 extends in the left-right direction. The transfer-roller housing part 210 rotatably houses the transfer roller 218 therein.

In the second embodiment, a process cartridge 203 includes the developing cartridge 15 and the drum cartridge 214. Thus, the transfer roller 218 can be attached to and detached from the housing 2 together with the process cartridge 203.

Figure 11:
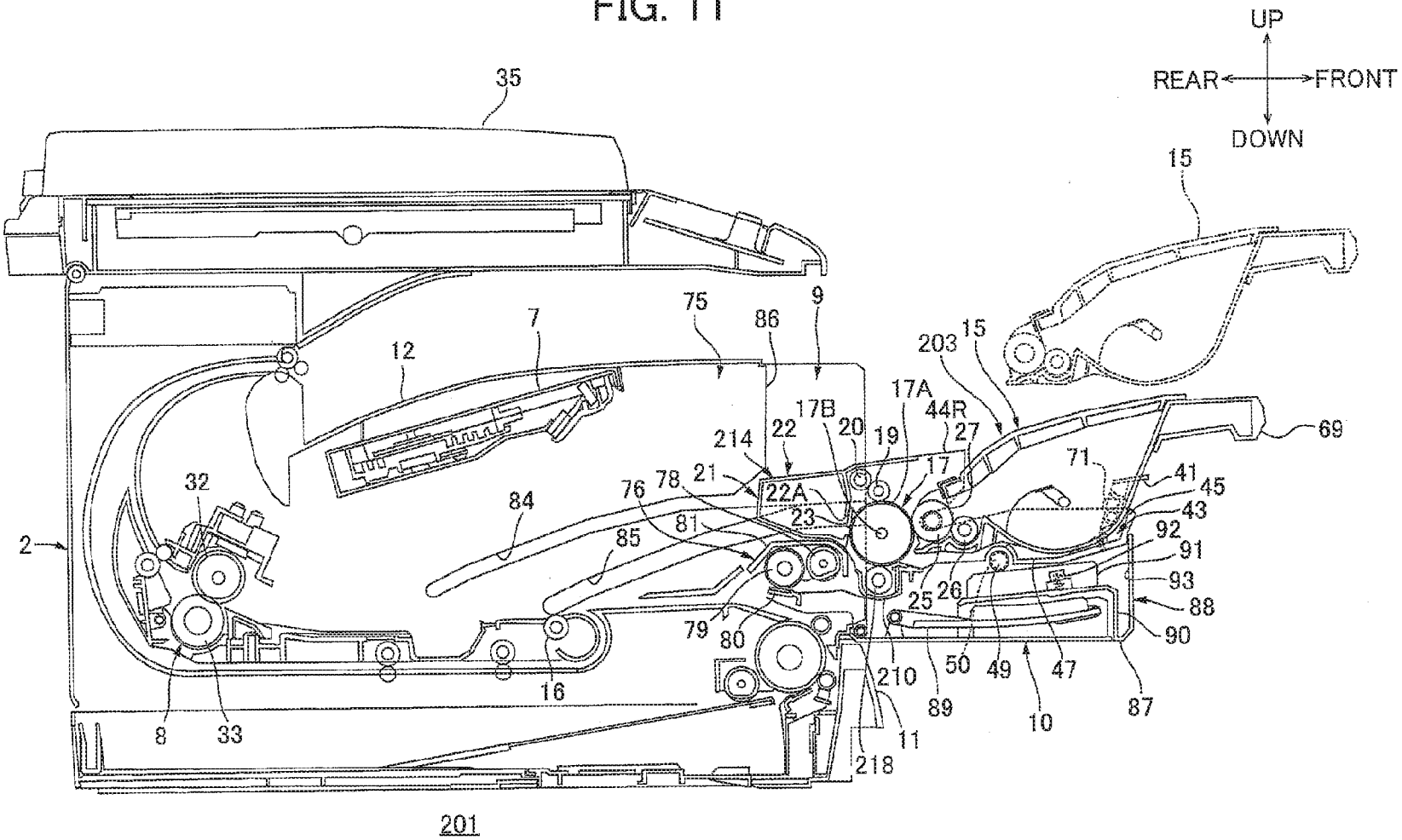
FIG. 11 is a cross-sectional side view of the image-forming apparatus according to the second embodiment, wherein the process cartridge having been detached from the housing is supported by the first support portion, the second support portion, and the third support portion.

As in the above-described first embodiment, the process cartridge 203 detached from the housing 2 is supported on the first support part 81, second support part 88, and two support tables 91, as illustrated in FIG. 11. At this time, the transfer-roller housing part 210 supporting the transfer roller 218 is positioned between the first support part 81 and the two support tables 91 in the front-rear direction.

As described above, according to the image-forming apparatus 201 of the second embodiment, as illustrated in FIG. 11, the transfer roller 218 is provided in the drum cartridge 214.

That is, the transfer roller 218 can be positioned outside the housing 2 when the drum cartridge 214 is detached from the housing 2.

Accordingly, when the sheet P is jammed between the photosensitive drum 17 and the transfer roller 218, this structure can facilitate removal of the jammed sheet P.

Further, when the process cartridge 203 of the second embodiment has been detached from the housing 2, the photosensitive drum 17 can be protected by the transfer-roller housing part 210.

Further, the structure of the second embodiment described above can obtain the same operational and technical advantages as the first embodiment.

Third Embodiment

Next, an image-forming apparatus 301 according to a third embodiment will be described with reference to FIGS. 12A and 12B. In the following description of the third embodiment, like parts and components are designated with the same reference numerals as those of the first embodiment to avoid duplicating explanation.

In the first embodiment, the front end portion of the process cartridge 3 is supported only by the cover 10, as illustrated in FIG. 7.

Figure 12B:
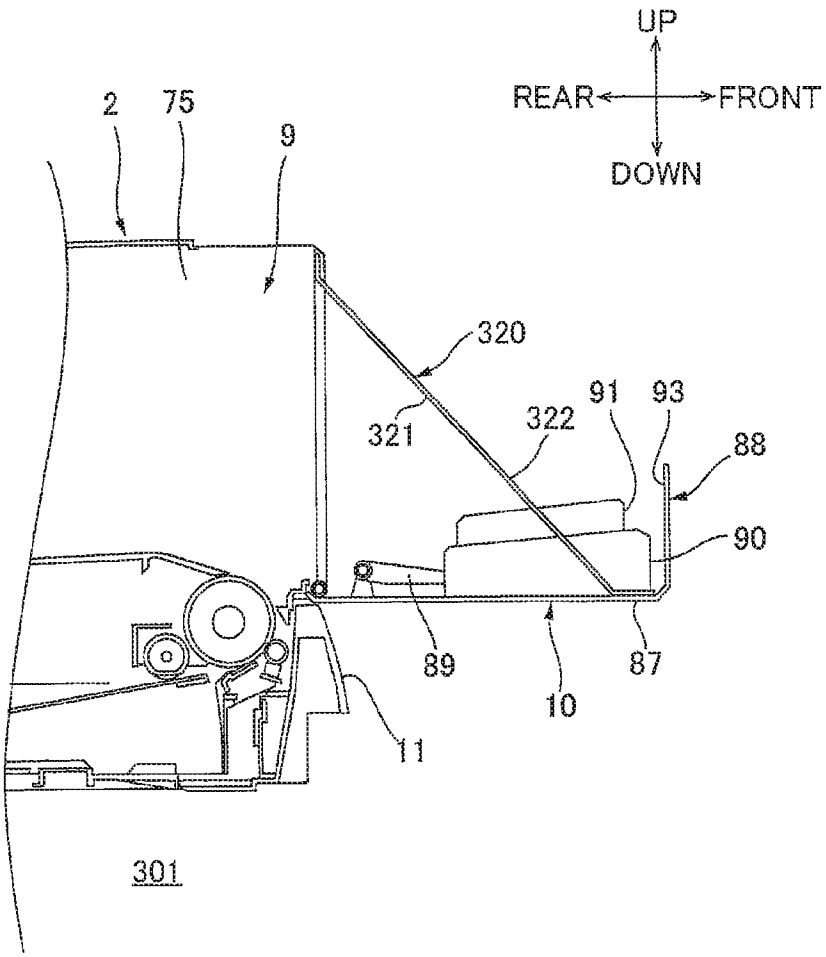
FIG. 12B is a cross-sectional side view of the front end portion of the image-forming apparatus according to the third embodiment, wherein the cover thereof is in an opened position.
Figure 12A:
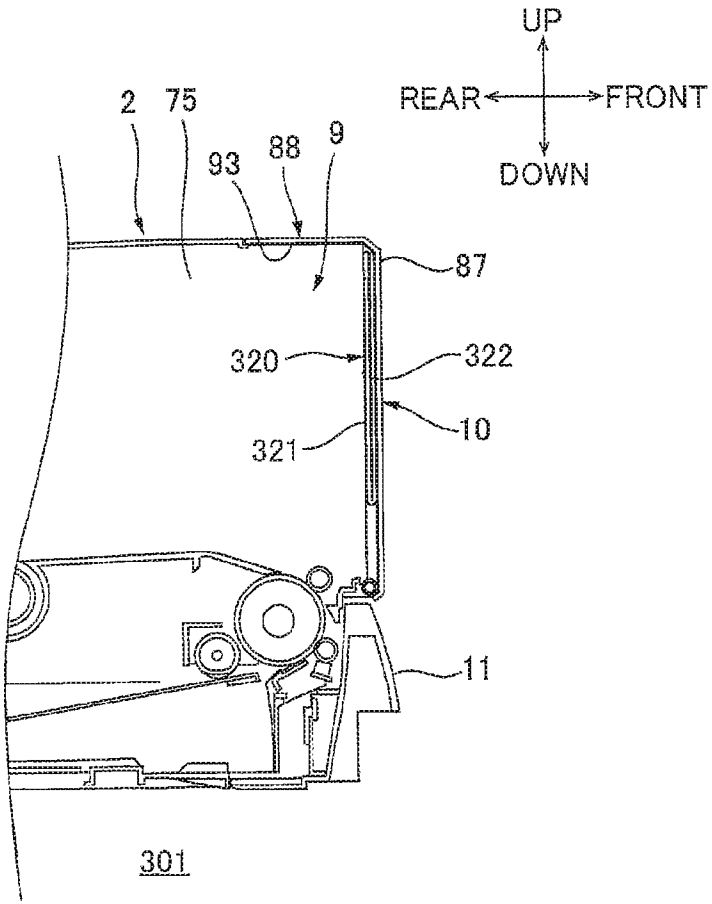
FIG. 12A is a cross-sectional side view of a front end portion of an image-forming apparatus according to a third embodiment, wherein a cover thereof is in a closed position.

On the other hand, in the third embodiment, the front end portion of the process cartridge 3 is supported by the cover 10 reinforced by a reinforcing part 320, as illustrated in FIGS. 12A and 12B.

Specifically, as illustrated in FIG. 12B, the reinforcing part 320 is provided between the side wall 75 and the cover 10. More specifically, the reinforcing part 320 connects an upper end portion of the side wall 75 and a front end portion of the major portion of the cover body 87 of the cover 10 at the opened position.

The reinforcing part 320 has a retractable structure. The reinforcing part 320 includes a first part 321 and a second part 322.

The first part 321 has a rod-like shape. The first part 321 has one end fixed to the upper end portion of the side wall 75 such that the first part 321 can be bent relative to the upper end portion of the side wall 75. The first part 321 has another end that is connected to the second part 322. The first part 321 can be bent relative to the second part 322.

The second part 322 has a rod-like shape. The second part 322 has one end fixed to the end portion of the cover body 87 near the second support part 88. The second part 322 can be bent relative to the cover body 87. The second part 322 has another end that is connected to the first part 321. The second part 322 can be bent relative to the first part 321, as described above.

As illustrated in FIG. 12A, when the cover 10 is at the closed position, the reinforcing part 320 is bent at a connection point between the first part 321 and the second part 322 such that the one end of the first part 321 and the one end of the second part 322 approach each other.

As a result, the reinforcing part 320 is retracted and accommodated between the side wall 75 and the cover 10.

On the other hand, as illustrated in FIG. 12B, when the cover 10 is at the opened position, the reinforcing part 320 is extended to connect the upper end portion of the side wall 75 and the end portion of the cover body 87 near the second support part 88.

With this structure, the reinforcing part 320 provides reinforcement to the cover 10 at the opened position.

As described above, according to the image-forming apparatus 301 of the third embodiment, as illustrated in FIG. 12B, the cover 10 at the opened position is reinforced by the reinforcing part 320.

Thus, the cover 10 can support the process cartridge 3 detached from the housing 2 more stably.

Further, the structure of the third embodiment can achieve the same operational and technical advantages as the first embodiment.

Fourth Embodiment

Next, an image-forming apparatus 401 according to a fourth embodiment will be described with reference to FIGS. 13A through 15D. In the following description of the fourth embodiment, like parts and components are designated with the same reference numerals as those of the first embodiment to avoid duplicating explanation.

(1) Configuration of Fourth Embodiment

Figure 13:
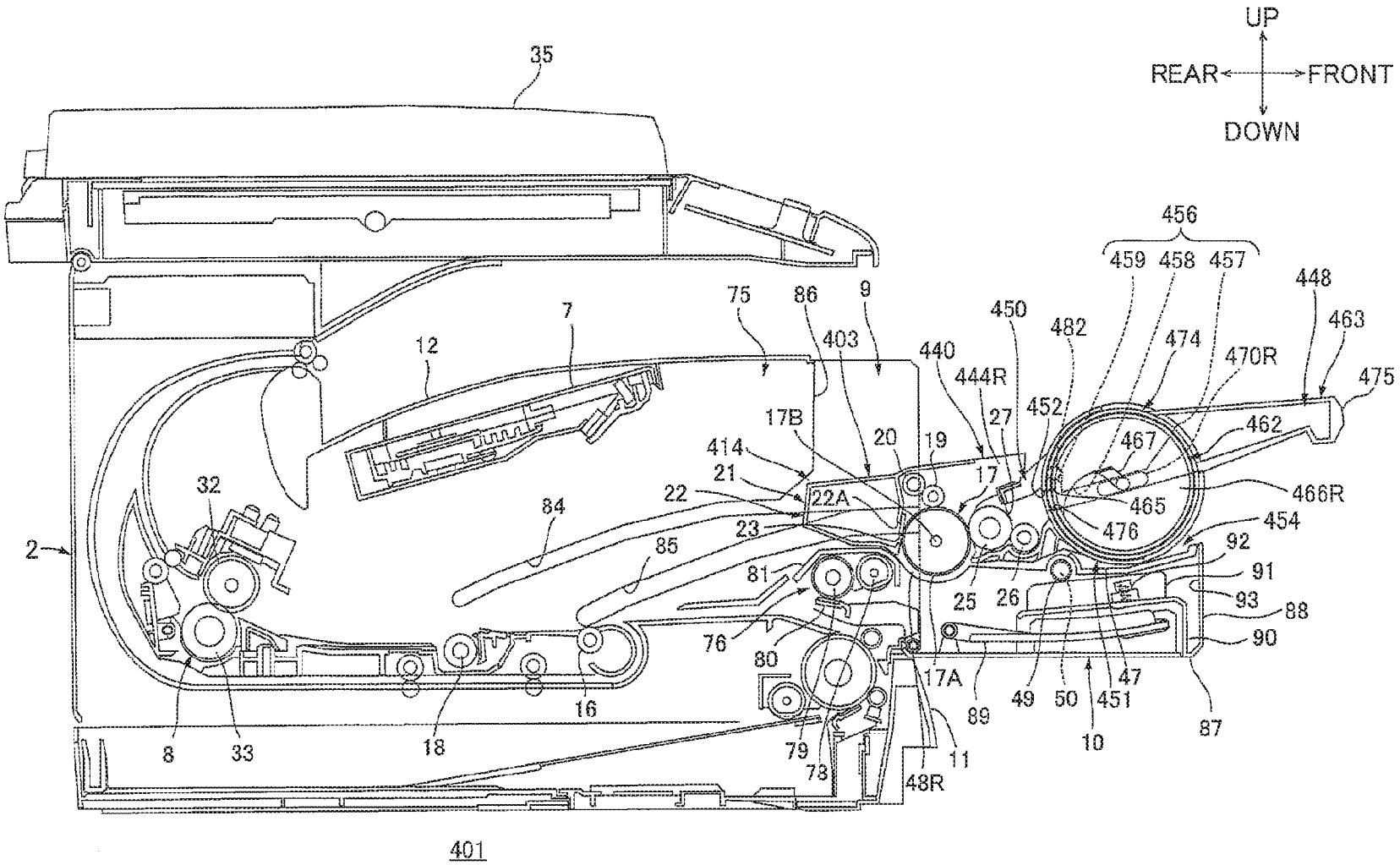
FIG. 13 is a cross-sectional view of an image-forming apparatus according to a fourth embodiment, wherein the cover is in its opened position and a switching member of a toner cartridge is at is non-restriction position.

In the first embodiment, as illustrated in FIG. 1, the process cartridge 3 includes the developing cartridge 15 having the developing roller 25 and supply roller 26. However, a process cartridge 403 of the fourth embodiment includes a drum cartridge 414 and a toner cartridge 448 that stores toner therein, as illustrated in FIG. 13. The toner cartridge 448 is another example of the toner cartridge.

(1-1) Configuration of Drum Cartridge

In the fourth embodiment, the drum cartridge 414 includes the photosensitive drum 17 and the drum frame 40 as in the first embodiment. The drum cartridge 414 of the fourth embodiment further includes a developing device 450 and an arcuate wall 451 having a receiving port 452.

The developing device 450 is positioned at a substantially center of a drum frame 440 constituting the drum cartridge 414 in the front-rear direction. The developing device 450 has a substantially rectangular cylindrical shape and extends in the left-right direction. The developing device 450 is configured to receive toner therein that is to be supplied from the toner cartridge 448 attached to the drum cartridge 414. The developing device 450 includes the above-described developing roller 25, the supply roller 26, and the layer-thickness regulation blade 27.

The arcuate wall 451 is positioned at the substantially center of the drum frame 440 of the drum cartridge 414 in the front-rear direction. The arcuate wall 451 also serves as a front wall defining the developing device 450. The arcuate wall 451 has a substantially arcuate shape. That is, the arcuate wall 451 is curved frontward as extending upward and downward.

The receiving port 452 is formed at a substantially vertical center in the arcuate wall 451. The receiving port 452 penetrates a generally vertical center portion of the arcuate wall 451 in the front-rear direction. With this structure, the inside and outside of the developing device 450 can communicate with each other through the receiving port 452.

In the drum frame 440, a region frontward of the arcuate wall 451 functions as a toner cartridge attachment part 454 for accommodating the toner cartridge 448.

The drum cartridge 414 includes a pair of side walls including a right side wall 444R and a left side wall (not shown). The right side wall 444R of the drum cartridge 414 is not provided with the groove part 53R as in the first embodiment, but is provided with a groove part 456.

The groove part 456 is adapted to guide attachment/detachment of the toner cartridge 448 to/from the drum cartridge 414. The groove part 456 is provided at the toner cartridge attachment part 454. The groove part 456 is recessed outward in the left-right direction (rightward) from the inner surface (left surface) of the right side wall 444R in the left-right direction. The groove part 456 extends in the front-rear direction and has a front end that is open frontward. The groove part 456 includes a wide part 457, a narrow part 458, and a first engagement part 459.

The wide part 457 constitutes a front end portion of the groove part 456. The wide part 457 is tapered toward the rear.

The narrow part 458 continues from a rear end portion of the wide part 457 and extends rearward therefrom. The narrow part 458 constitutes an intermediate portion of the groove part 456. The narrow part 458 has a constant groove width.

The first engagement part 459 continues from a rear end portion of the narrow part 458 and extends upward therefrom. The first engagement part 459 constitutes a rear end portion of the groove part 456. The first engagement part 459 has a concave shape and extends along an inner peripheral surface (front surface) of the arcuate wall 451.

The left side wall (not shown) has the same structure as the right side wall 444R. Thus, the left side wall is also provided with the groove part 456.

(1-2) Configuration of Toner Cartridge

Figure 15A:
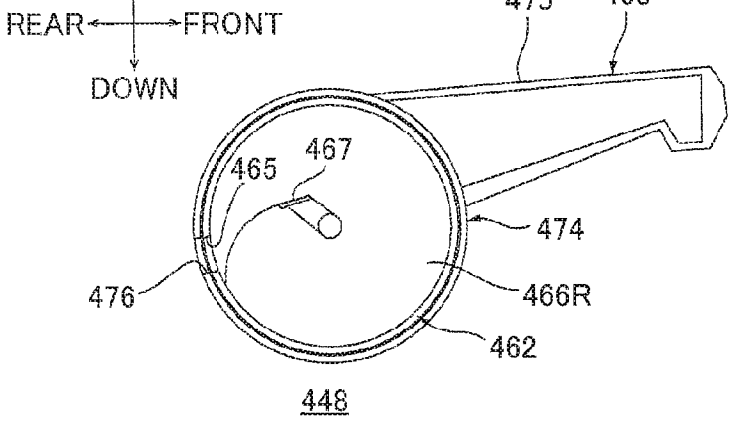
FIG. 15A is a cross-sectional side view of the toner cartridge shown in FIG. 13.
Figure 15B:
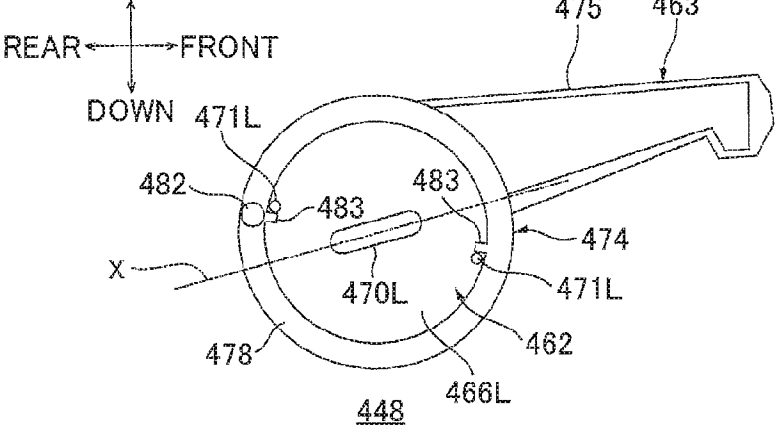
FIG. 15B is a side view of the toner cartridge of FIG. 15A.

The toner cartridge 448 is attachable to the toner cartridge attachment part 454 of the drum cartridge 414. As illustrated in FIGS. 15A and 15B, the toner cartridge 448 includes a housing cylinder 462 having a first opening 465, and a switching member 463.

The housing cylinder 462 has a substantially cylindrical shape. The housing cylinder 462 extends in the left-right direction. The housing cylinder 462 includes a left closed wall 466L and a right closed wall 466R.

The left closed wall 466L closes a left end portion of the housing cylinder 462. The left closed wall 466L has a substantially circular shape in a side view. The left closed wall 466L is plate-like shaped. The left closed wall 466L includes a boss 470L and two stoppers 471L.

The boss 470L protrudes outward in the left-right direction (leftward) from an outer surface (left surface) of the closed wall 466L in the left-right direction. The boss 470L has a substantially rectangular columnar shape. The boss 470L is adapted to be fitted into the narrow part 458 of the side wall 444L.

Referring to FIG. 15B, the two stoppers 471L are positioned on the left surface of the left closed wall 466L so as to be spaced apart from each other in the front-rear direction. The two stoppers 471L are positioned on an outer peripheral portion of the left closed wall 466L in a radial direction thereof. Specifically, the rear stopper 471L is positioned higher relative to a rear end portion of the boss 470L. The front stopper 471L is positioned lower relative to a front end portion of the boss 470L. Each of the stoppers 471L protrudes outward in the left-right direction (leftward) from the outer surface (left surface) of the left closed wall 466L. The stoppers 471L have a columnar shape.

The right closed wall 466R closes a right end portion of the housing cylinder 462. The right closed wall 466R has the same shape as the left closed wall 466L. As illustrated in FIG. 13, the right closed wall 466R includes a boss 470R that is adapted to be fitted to the narrow part 458 of the right side wall 444R.

An agitator 467 is positioned at the center of the housing cylinder 462. The agitator 467 is configured to agitate toner within the housing cylinder 462.

As illustrated in FIG. 15A, the first opening 465 is provided in a rear end portion of the housing cylinder 462. The first opening 465 penetrates the rear end portion of the housing cylinder 462 in the front-rear direction. As a result, the inside and the outside of the housing cylinder 462 communicate with each other. As illustrated in FIG. 13, the first opening 465 overlaps the receiving port 452 in the front-rear direction.

The switching member 463 is pivotable between a restriction position (FIG. 13) and a non-restriction position (FIG. 14) and is configured to switch attachment state of the toner cartridge 448 relative to the drum cartridge 414 in the process cartridge 403. Specifically, when the switching member 463 is at the restriction position, detachment of the toner cartridge 448 from the drum cartridge 414 is restricted. When the switching member 463 is at the non-restriction position, detachment of the toner cartridge 448 from the drum cartridge 414 is allowed. In the following description of the switching member 463, it is assumed that: the process cartridge 403 is supported on the first support part 81, second support part 88, and two support tables 91; the toner cartridge 448 is attached to the drum cartridge 414; and the switching member 463 is at the restriction position.

The switching member 463 includes an outer cylinder 474 having a second opening 476, and an operation part 475.

The outer cylinder 474 is provided to cover an outer peripheral surface of the housing cylinder 462. The outer cylinder 474 has a cylindrical shape and extends in the left-right direction. As illustrated in FIG. 15B, the outer cylinder 474 includes a cylindrical peripheral wall, and annular parts 478. The annular parts 478 are positioned at both end portions of the cylindrical peripheral wall of the outer cylinder 474 in the left-right direction. That is, there are two annular parts 478. Since the left and right annular parts 478, 478 have the same shape, only the left annular part 478 will be described.

The annular part 478 is provided at the left end portion of the cylindrical peripheral wall constituting the outer cylinder 474. The annular part 478 is positioned outside the housing cylinder 462 in the left-right direction. The annular part 478 has a plate-like shape and has an annular shape in a side view. That is, the annular part 478 has a thickness in a radial direction of the outer cylinder 474. The annular part 478 includes a second engagement part 482 and two abutting parts 483.

The second engagement part 482 is positioned at a rear end portion of the annular part 478. Assuming a virtual line X that extends along the boss 470L, the second engagement part 482 is arranged above the virtual line X. The second engagement part 482 extends outward (leftward) from an outer surface (left surface) of the annular part 478 in the left-right direction. The second engagement part 482 has a columnar shape in a side view and is convex leftward. The second engagement part 482 is adapted to be fitted to the first engagement part 459 of the left side wall (not shown). That is, the second engagement part 482 is adapted to be engaged with the corresponding first engagement part 459.

The two abutting parts 483 are positioned on the annular part 478 so as to be spaced apart from each other in the front-rear direction. The abutting parts 483 are positioned at an inner peripheral surface of the annular part 478. Specifically, each abutting part 483 extends inward in the radial direction of the annular part 478 from the inner peripheral surface of the annular part 478. Each of the abutting parts 483 has a rectangular columnar shape. Specifically, one of the abutting parts 483 is positioned at the rear end portion of the annular part 478. This rear abutting part 483 is positioned forward of the second engagement part 482. The rear abutting part 483 is adapted to abut against a lower end portion of the rear stopper 471L. The other one of the abutting parts 483 is positioned at a front end portion of the annular part 478. This front abutting part 483 is adapted to abut against an upper end portion of the front stopper 471L.

As illustrated in FIG. 15A, the second opening 476 is formed in a rear end portion of the cylindrical peripheral wall constituting the outer cylinder 474. The second opening 476 penetrates the rear end portion of the outer cylinder 474 in the front-rear direction. As illustrated in FIG. 13, the second opening 476 is adapted to coincide in position with the first opening 465 and receiving port 452 in the front-rear direction. As a result, the housing cylinder 462 and the developing device 450 can communicate with each other through the receiving port 452, second opening 476 and operation part 475 when the switching member 463 is in the restriction position.

Figure 14:
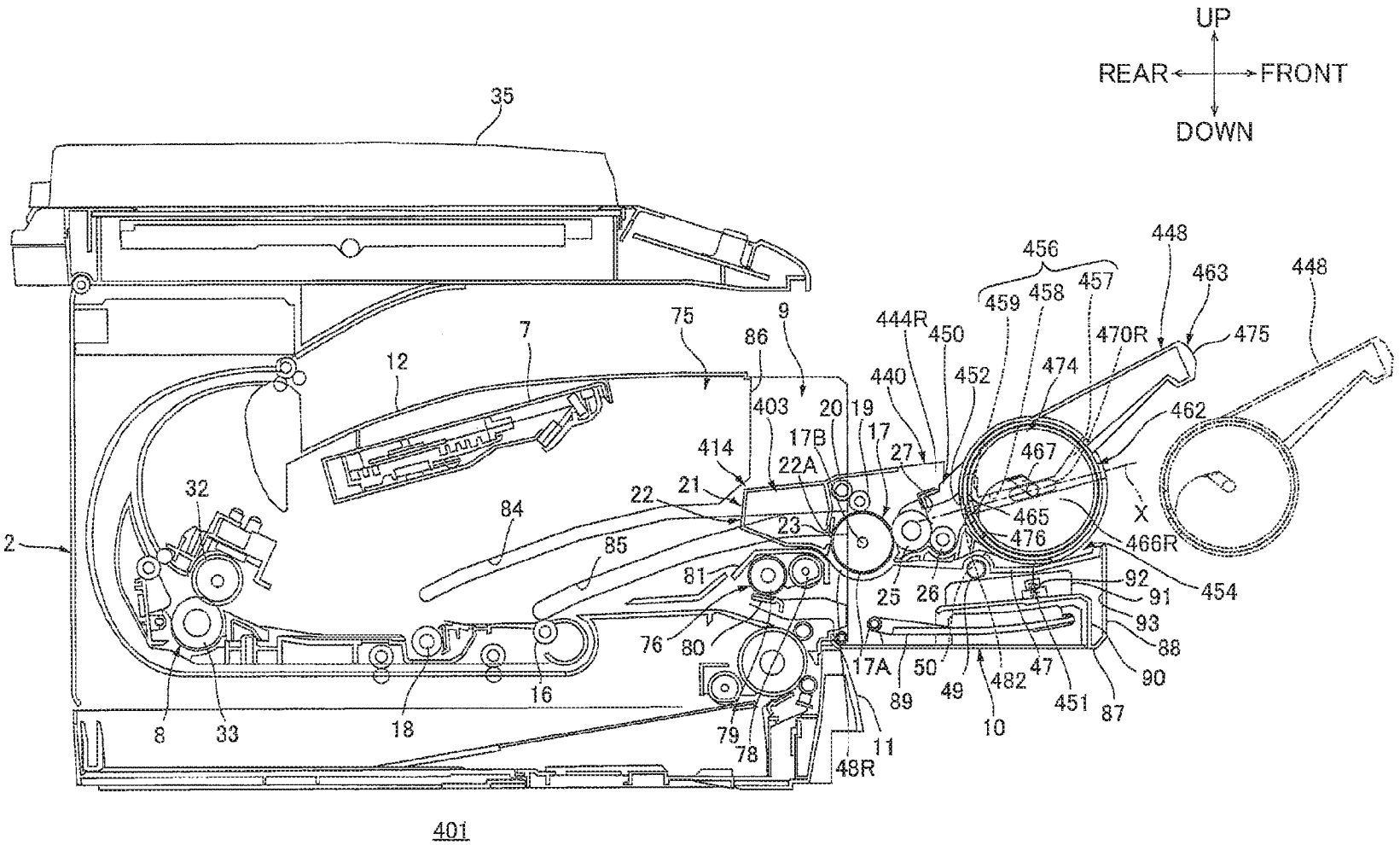
FIG. 14 is a cross-sectional view of the image-forming apparatus according to the fourth embodiment, and explaining detachment of the toner cartridge.

The operation part 475 constitutes at a front end portion of the switching member 463. When the process cartridge 403 is supported on the first support part 81, second support part 88, and two support tables 91, the operation part 475 is located outside the inner space of the housing 2, as shown in FIGS. 13 and 14. Although not illustrated, when the process cartridge 403 is mounted in the housing 2, the operation part 475 is positioned inside the inner space of the housing 2. The operation part 475 extends forward continuously from the front end portion of the outer cylinder 474. The operation part 475 extends in the left-right direction. The operation part 475 has a substantially rectangular cylindrical shape. The operation part 475 is another example of the handle.

The switching member 463 is moved from the restriction position (FIG. 13) to the non-restriction position (FIG. 14) when the operation part 475 is moved upward to rotate the outer cylinder 474 in the counterclockwise direction in a left side view along the outer peripheral surface of the housing cylinder 462.

Figure 15C:
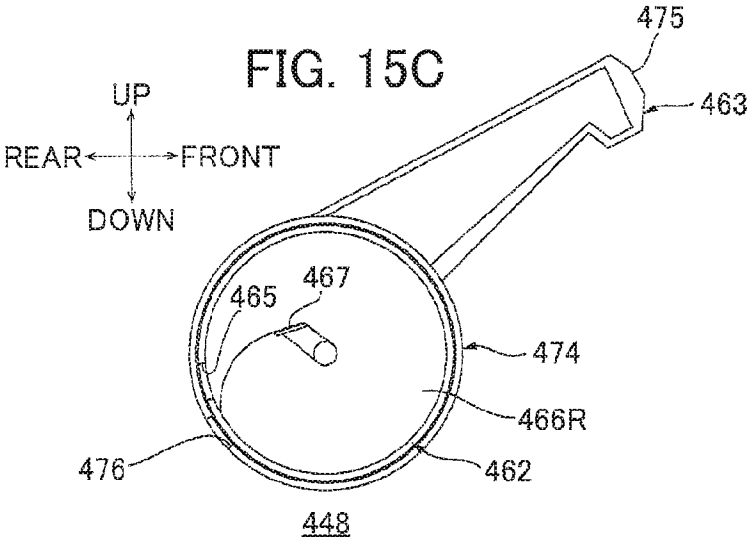
FIG. 15C is a cross-sectional side view of the toner cartridge of FIG. 14.
Figure 15D:
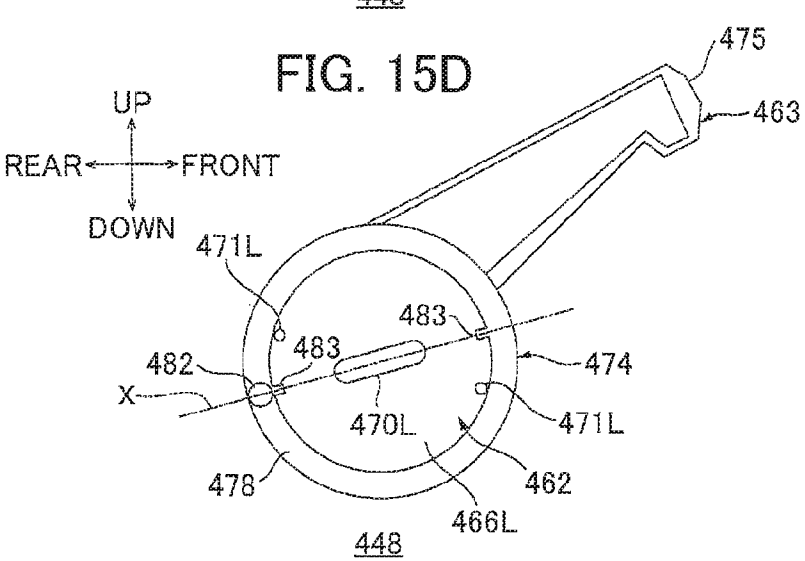
FIG. 15D is a side view of the toner cartridge of FIG. 15C.

When the switching member 463 is at the non-restriction position, the operation part 475 extends obliquely upward and forward, as illustrated in FIGS. 15C and 15D.

In the non-restriction position, the rear abutting part 483 of the annular part 478 is positioned below the rear stopper 471L. The front abutting part 483 of the annular part 478 is positioned above the front stopper 471L. The second engagement part 482 of the annular part 478 is positioned on the virtual line X along which the boss 470L extends. Further, the second opening 476 of the outer cylinder 474 is displaced from the first opening 465 to be positioned therebelow, and the cylindrical peripheral wall of the outer cylinder 474 closes the first opening 465.

(2) Attachment/Detachment Operation of Toner Cartridge

As in the first embodiment, to detach the toner cartridge 448 from the drum cartridge 414, the user first moves the cover 10 to the opened position, as illustrated in FIG. 13.

Then, the user detaches the process cartridge 403 from the housing 2 and sets the detached process cartridge 3 on the first support part 81, second support part 88, and two support tables 91.

Subsequently, as illustrated in FIG. 14, the user detaches the toner cartridge 448 from the drum cartridge 414 while the drum cartridge 414 is supported on the first support part 81, second support part 88, and two support tables 91.

In order to detach the toner cartridge 448 from the drum cartridge 414, the user operates the operation part 475 of the switching member 463, which is at the restriction position, to rotate the outer cylinder 474 in the counterclockwise direction in a left side view thereof, thereby moving the switching member 463 to the non-restriction position.

In accordance with rotation of the outer cylinder 474, the second engagement part 482 is moved downward along the first engagement part 459 to reach the lower end portion of the first engagement part 459. The second engagement part 482 thus is brought into abutment with the lower end portion of the narrow part 458. The second engagement part 482 of the annular part 478 is thus positioned on the virtual line X, as shown in FIG. 15D.

Likewise, the second opening 476 of the outer cylinder 474 is displaced from the first opening 465 to be positioned therebelow, and the cylindrical peripheral wall of the outer cylinder 474 closes the first opening 465.

In the non-restriction position of the switching member 463, the restriction of detachment of the toner cartridge 448 from the drum cartridge 414 is released. That is, engagement between the second engagement parts 482 and the corresponding first engagement parts 459 is released. Thus, the toner cartridge 448 is now ready to be detached from the drum cartridge 414.

The user then grips the operation part 475 of the toner cartridge 448, which is now made detachable from the drum cartridge 414, to pull out the toner cartridge 448. The boss 470L and the left second engagement part 482 are guided along the left narrow part 458 and the wide part 457. Likewise, the boss 470R and the right second engagement part 482 are guided along the right narrow part 458 and the wide part 457. In this manner, the toner cartridge 448 is detached from the drum cartridge 414.

In order to attach the toner cartridge 448 to the drum cartridge 414, the user attaches the toner cartridge 448 to the drum cartridge 414 supported on the first support part 81, second support part 88, and two support tables 91.

Specifically, the left second engagement part 482 and the boss 470L are guided along the left wide part 457 and the narrow part 458, while the right second engagement part 482 and the boss 470R are guided along the right wide part 457 and the narrow part 458. That is, the switching member 463 is at the non-restriction position at this time.

Once the respective second engagement parts 482 and the bosses 470L, 470R reach the lower end portion of the corresponding narrow parts 458, the user operates the operation part 475 to rotate the outer cylinder 474 in the clockwise direction in a left side view thereof, thereby moving the switching member 463 to the restriction position from the non-restriction position.

In the restriction position of the switching member 463, detachment of the toner cartridge 448 from the drum cartridge 414 is restricted due to engagement of the second engagement parts 482 with the first engagement parts 459 of the respective groove parts 456.

Attachment of the toner cartridge 448 to the drum cartridge 414 is thus completed.

Then, the user pushes the process cartridge 403 into the housing 2, and subsequently moves the cover 10 to the closed position.

The process cartridge 403 is thus mounted in the housing 2.

(3) Operational and Technical Advantages of the Fourth Embodiment

The structure of the fourth embodiment can achieve the same operational and technical advantages as the first embodiment.

<Variations and Modifications>

In the above-described embodiments, the cleaning member 23 is a cleaning blade having a plate-like shape. Alternatively however, the cleaning member 23 may be a cleaning roller having a columnar shape, for example.

Further, in the above-described embodiments, the manual feed unit 76 includes the first support part 81 functioning as the cover for protecting the conveying rollers 78 and 79. Alternatively, however, the manual feed unit 76 may include, as a member separate from the first support part 81, a conveying-roller cover provided between the first support part 81 and the conveying rollers 78 and 79.

Further, in the depicted third embodiment, the first and second parts 321 and 322 of the reinforcing part 320 have a rod-like shape. Alternatively, however, the first and second parts 321 and 322 may have a plate-like shape.

While the disclosure is described in detail with reference to the specific embodiments thereof while referring to accompanying drawings, it would be apparent to those skilled in the art that many modifications and variations may be made therein without departing from the scope of the disclosure.

What is claimed is:

1. An image-forming apparatus comprising:

a housing formed with an opening part, the housing comprising:

a first support part arranged at the opening part; and a cover movable between a closed position closing the opening part and an opened position exposing the opening part, the cover including a second support part; and a process cartridge detachable and attachable relative to the housing through the opening part in a first direction when the cover is at the opened position, the second support part being positioned away from the first support part in the first direction when the cover is at the opened position, the process cartridge detached from the housing being configured to be supported by the first support part and the second support part when the cover is at the opened position, the process cartridge comprising:

a drum cartridge including a photosensitive drum and a drum frame supporting the photosensitive drum; and a toner cartridge attachable to and detachable from the drum frame, the first support part and the second support part being configured to support the drum frame of the drum cartridge constituting the process cartridge to restrict displacement of the drum frame in the first direction when the cover is at the opened position, wherein the process cartridge further comprises a switching member configured to restrict and allow detachment of the toner cartridge relative to the drum cartridge, the switching member having a portion arranged outside of the opening part while the drum frame is supported by the first support part and the second support part.

2. The image-forming apparatus as claimed in claim 1, wherein the first support part and the second support part are configured to support the drum frame such that the drum frame is sandwiched between the first support part and the second support part in the first direction.

3. The image-forming apparatus as claimed in claim 1, wherein the switching member is provided on the drum frame.

4. The image-forming apparatus as claimed in claim 1, wherein the toner cartridge includes a handle, the handle having a portion arranged outside of the opening part while the drum frame is supported by the first support part and the second support part.

5. The image-forming apparatus as claimed in claim 1, wherein the cover further comprises a support table configured to support the drum frame that is supported by the first support part and the second support part.

6. The image-forming apparatus as claimed in claim 5, wherein the support table is positioned between the first support part and the second support part in the first direction when the cover is at the opened position.

7. The image-forming apparatus as claimed in claim 5, wherein the support table is separated from the process cartridge when the process cartridge is attached to the housing and the cover is at the closed position.

8. The image-forming apparatus as claimed in claim 1, wherein the cover further comprises a pressing part, the pressing part being configured to urge the toner cartridge toward the drum cartridge when the process cartridge is attached to the housing and the cover is at the closed position, and wherein the pressing part is separated from the process cartridge when the process cartridge detached from the housing is supported by the first support part and the second support part and the cover is at the opened position.

9. The image-forming apparatus as claimed in claim 8, wherein the photosensitive drum defines an axis extending in an axial direction, and wherein the pressing part is separated from the process cartridge in a second direction perpendicular to the first direction and the axial direction.

10. The image-forming apparatus as claimed in claim 1, wherein the photosensitive drum defines an axis extending in an axial direction, and wherein the cover further comprises:

a support table configured to support the drum frame supported by the first support part and the second support part; and a pressing part configured to urge the toner cartridge toward the drum cartridge when the process cartridge is attached to the housing and the cover is at the closed position, the pressing part being separated from the process cartridge detached from the housing and supported by the first support part and the second support part when the cover is at the opened position, the support table being disposed outward of the pressing part in the axial direction.

11. The image-forming apparatus as claimed in claim 1, wherein the housing further comprises:

a conveying roller configured to convey a sheet; and a conveying-roller cover covering the conveying roller, the first support part including the conveying-roller cover.

12. The image-forming apparatus as claimed in claim 1, wherein the drum cartridge further includes a cleaner configured to clean a peripheral surface of the photosensitive drum, the cleaner comprising:

a cleaning member provided to be in contact with the peripheral surface of the photosensitive drum; and a waste toner container adapted to store waste toner removed from the peripheral surface of the photosensitive drum, the first support part supporting the waste toner container when the cover is in the opened position.

13. An image-forming apparatus comprising:

a housing formed with an opening part, the housing comprising:

a first support part arranged at the opening part;

a cover movable between a closed position closing the opening part and an opened position exposing the opening part, the cover including a second support part;

a conveying roller configured to convey a sheet; and a conveying-roller cover covering the conveying roller, the first support part including the conveying-roller cover and a process cartridge detachable and attachable relative to the housing through the opening part in a first direction when the cover is at the opened position, the second support part being positioned away from the first support part in the first direction when the cover is at the opened position, the process cartridge detached from the housing being configured to be supported by the first support part and the second support part when the cover is at the opened position, the process cartridge comprising:

a drum cartridge including a photosensitive drum and a drum frame supporting the photosensitive drum; and a toner cartridge attachable to and detachable from the drum frame, the first support part and the second support part being configured to support the drum frame of the drum cartridge constituting the process cartridge to restrict displacement of the drum frame in the first direction when the cover is at the opened position.

14. An image-forming apparatus comprising:

a housing formed with an opening part, the housing comprising:

a first support part arranged at the opening part; and a cover movable between a closed position closing the opening part and an opened position exposing the opening part, the cover including a second support part; and a process cartridge detachable and attachable relative to the housing through the opening part in a first direction when the cover is at the opened position, the second support part being positioned away from the first support part in the first direction when the cover is at the opened position, the process cartridge detached from the housing being configured to be supported by the first support part and the second support part when the cover is at the opened position, the process cartridge comprising:

a drum cartridge including a photosensitive drum, a drum frame supporting the photosensitive drum, and a cleaner configured to clean a peripheral surface of the photosensitive drum, the cleaner comprising:

a cleaning member provided to be in contact with the peripheral surface of the photosensitive drum; and a waste toner container adapted to store waste toner removed from the peripheral surface of the photosensitive drum, the first support part supporting the waste toner container when the cover is in the opened position; and a toner cartridge attachable to and detachable from the drum frame, the first support part and the second support part being configured to support the drum frame of the drum cartridge constituting the process cartridge to restrict displacement of the drum frame in the first direction when the cover is at the opened position.

* * * * *